US005554066A

United States Patent [19]

Bosten et al.

[11] Patent Number: 5,554,066

[45] Date of Patent: Sep. 10, 1996

[54] IN-LINE PROFILE SANDER

[75] Inventors: Donald R. Bosten; John R. Kriaski, both of Jackson; Randy G. Cooper, Milan; John C. Smith, Jackson, all of Tenn.

[73] Assignee: Proter-Cable Corporation, Jackson, Tenn.

[21] Appl. No.: 385,910

[22] Filed: Feb. 9, 1995

[51] Int. Cl.[6] ..... B24B 23/00

[52] U.S. Cl. ..... 451/356; 451/527

[58] Field of Search ..... 451/356, 351, 451/527

[56] References Cited

U.S. PATENT DOCUMENTS

| | | | |
|---|---|---|---|
| D. 329,362 | 9/1992 | Saito et al. . | |
| D. 332,558 | 1/1993 | Hoshino et al. . | |
| 1,412,725 | 4/1922 | Vernon . | |
| 1,501,192 | 7/1924 | Severns . | |
| 1,800,341 | 4/1931 | Davies . | |
| 1,840,254 | 1/1932 | Richardson . | |
| 2,350,098 | 5/1944 | Decker . | |
| 2,469,821 | 5/1949 | Galbraith . | |
| 2,689,436 | 9/1954 | Wagner . | |
| 2,836,940 | 6/1958 | Carmichael . | |
| 3,160,995 | 12/1964 | Danuski, Jr. . | |
| 3,190,045 | 6/1965 | Zuzelo . | |
| 3,443,271 | 5/1969 | Lyons . | |
| 3,619,954 | 11/1971 | Miller . | |
| 3,785,092 | 1/1974 | Hutchins . | |
| 3,892,091 | 7/1975 | Hutchins . | |
| 4,055,029 | 10/1977 | Kalbow | 451/527 |
| 4,380,092 | 4/1983 | Brothers . | |
| 4,398,375 | 8/1983 | Malyuk | 451/356 |
| 4,671,019 | 6/1987 | Hutchins . | |
| 4,905,420 | 3/1990 | Flachenecker et al. . | |
| 4,920,702 | 5/1990 | Kloss et al. . | |
| 5,123,216 | 6/1992 | Kloss et al. | 451/357 |
| 5,319,889 | 6/1994 | Rudolf et al. | 451/456 |
| 5,398,454 | 3/1995 | Berner | 451/357 |

FOREIGN PATENT DOCUMENTS

| | | |
|---|---|---|
| 737766 | 12/1932 | France . |
| 952683 | 11/1949 | France . |
| 2365411 | 9/1976 | France . |
| 2420276 | 11/1979 | France . |
| 2516842 | 5/1986 | France . |
| 886216 | 7/1949 | Germany . |
| 6935441 | 3/1971 | Germany . |

(List continued on next page.)

OTHER PUBLICATIONS

Hugh Foster, "Tool Talk," Popular Woodworking, Jul., 1994, pp. 80–82.

Sven Hanson, "Picking a Detail Sander," Popular Woodworking, Mar./Apr. 1995, pp. 52–54.

Bill Keier, "Detail Sanders", Wood Magazine, Nov. 1994, pp. 44–47.

"Tadpole Contour Sanders", Klingspor's Sanding Catalogue, vol. 17, 1994, cover sheet and p. 13.

*Primary Examiner*—Bruce M. Kisliuk
*Assistant Examiner*—Andrew Weinberg
*Attorney, Agent, or Firm*—Merchant, Gould, Smith, Edell, Welter & Schmidt

[57] ABSTRACT

An in-line sander comprising a sander body which houses a motor coupled to an in-line oscillating mechanism. The in-line oscillating mechanism is adapted and configured to move a sanding pad in a linear oscillating motion.

A preferred pad is a profiled sanding pad coupled to the in-line oscillating mechanism. The profiled sanding pad has, in a plane substantially perpendicular to the linear oscillating motion of the sander, a particular cross sectional profile corresponding to a profile to be formed onto or to be sanded on a workpiece. The cross sectional configuration extends substantially consistently along the length of the pad, and the pad defines a sanding surface having a profile corresponding to the particular cross sectional profile. With such profiled sanding pads, sandpaper secured to the sanding surface of the pads will power sand the profile to be formed onto or to be sanded on a workpiece.

16 Claims, 23 Drawing Sheets

FOREIGN PATENT DOCUMENTS

| | | |
|---|---|---|
| 2262865 | 7/1973 | Germany . |
| 2513464 | 10/1975 | Germany . |
| 2742062 | 3/1978 | Germany . |
| 2741255 | 3/1979 | Germany . |
| 2741325 | 3/1979 | Germany . |
| 3012836 | 10/1981 | Germany . |
| 3402062 | 8/1985 | Germany . |
| 8426106 | 10/1985 | Germany . |
| 554414 | 5/1986 | Germany . |
| 563174 | 6/1979 | Japan . |
| 276800 | 4/1962 | Netherlands . |
| 2141620 | 1/1985 | United Kingdom . |
| 87/02924 | 5/1987 | WIPO . |
| 94/04312 | 3/1994 | WIPO . |

IN-LINE PROFILE SANDER

BACKGROUND AND SUMMARY OF THE INVENTION

The present invention relates to an in-line sander comprising a sander body which houses a motor coupled to an in-line oscillating mechanism. The in-line oscillating mechanism is adapted and configured to move a sanding pad in a linear oscillating motion.

A preferred pad is a profiled sanding pad coupled to the in-line oscillating mechanism. The profiled sanding pad has, in a plane substantially perpendicular to the linear oscillating motion of the sander, a particular cross sectional profile corresponding to a profile to be formed onto or to be sanded on a workpiece. The cross sectional configuration extends substantially consistently along the length of the pad, and the pad defines a sanding surface having a profile corresponding to the particular cross sectional profile. With such profiled sanding pads, sandpaper secured to the sanding surface of the pads will power sand the profile to be formed onto or to be sanded on a workpiece.

DESCRIPTION OF THE PREFERRED EMBODIMENTS

Figure 1:
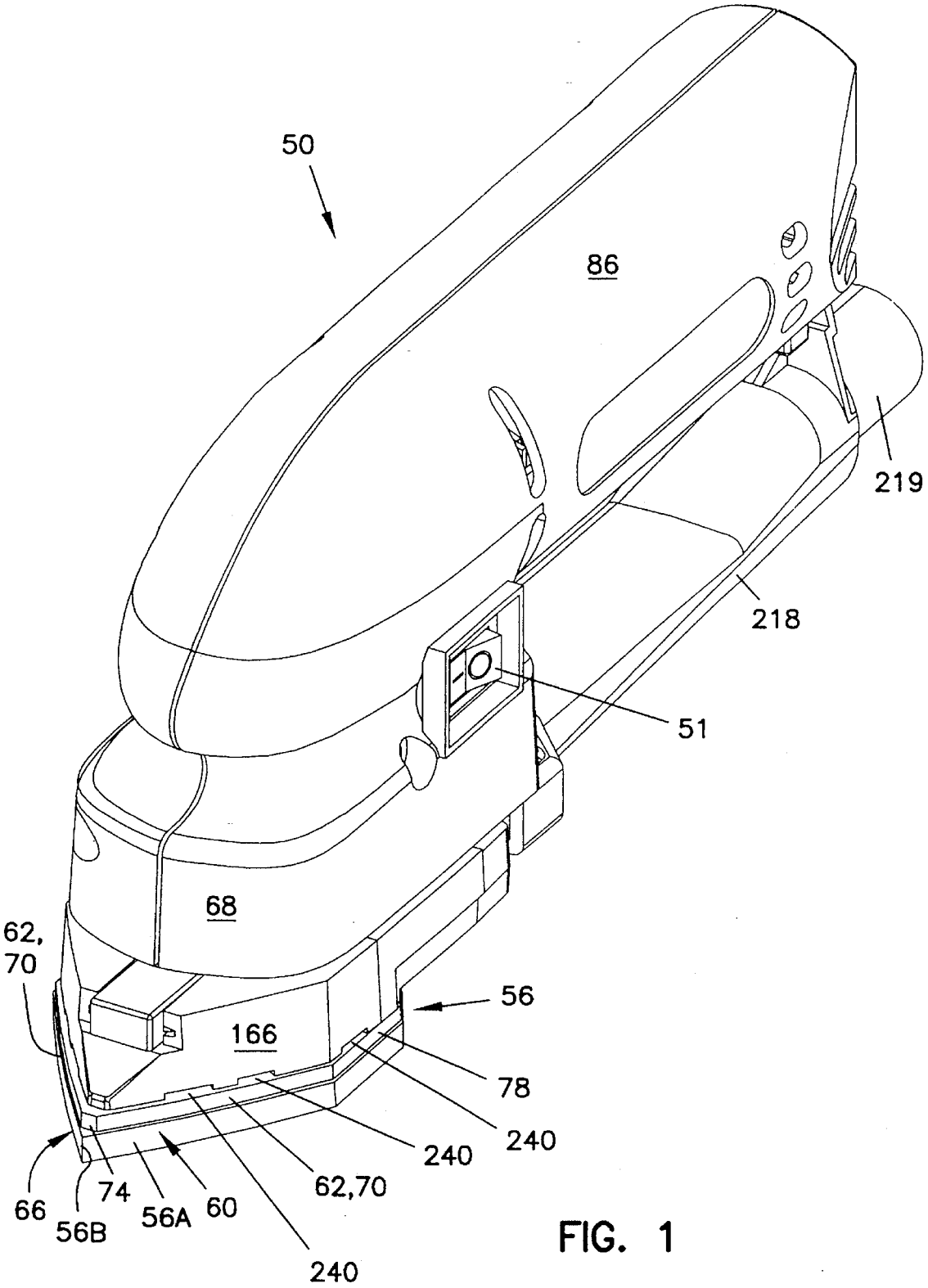
FIG. 1 illustrates a top left perspective view of a preferred embodiment of the present sander configured with a corner or detail sanding pad.
Figure 2:
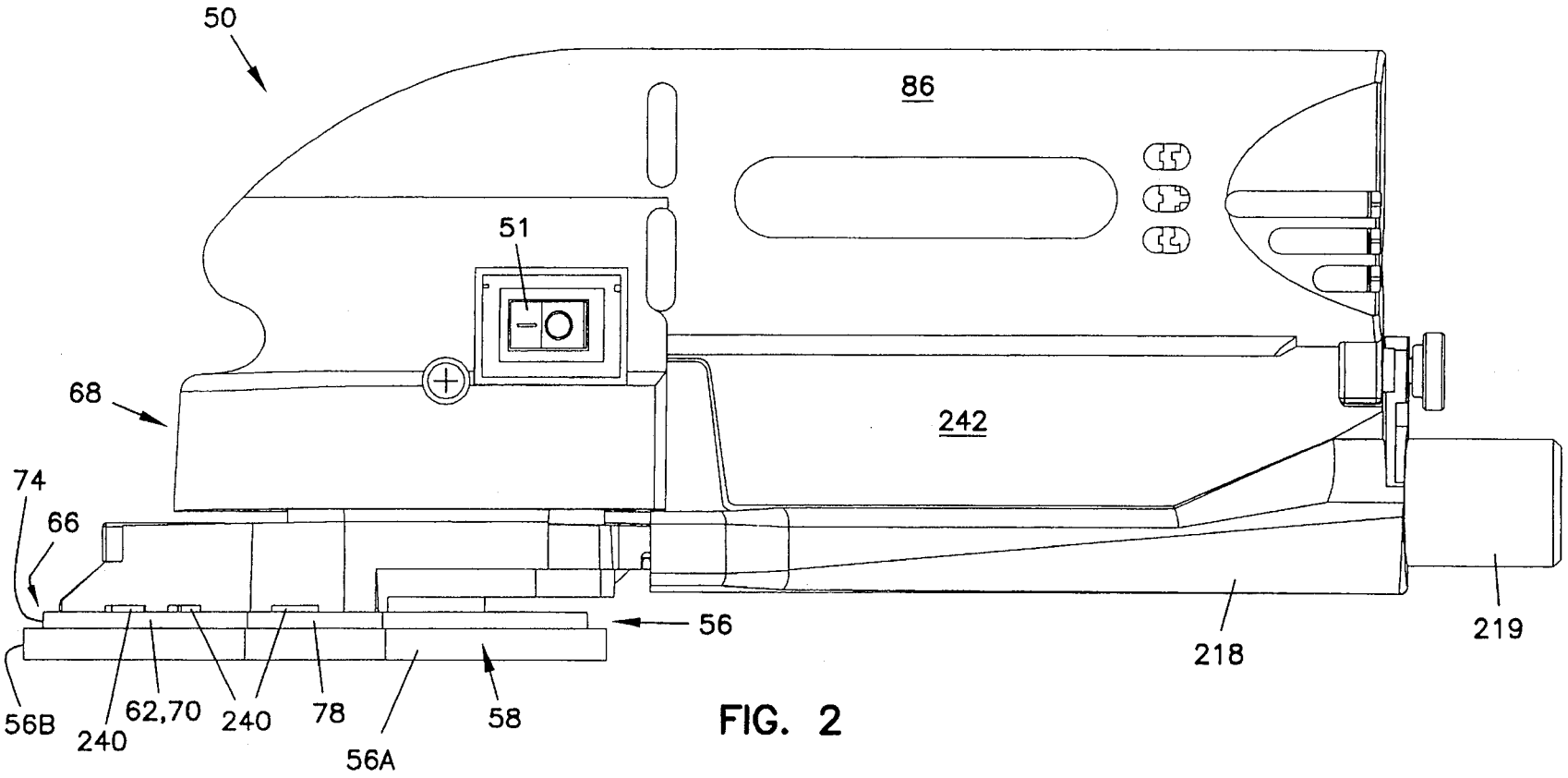
FIG. 2 illustrates a left side elevational view of the sander shown in FIG. 1.
Figure 3:
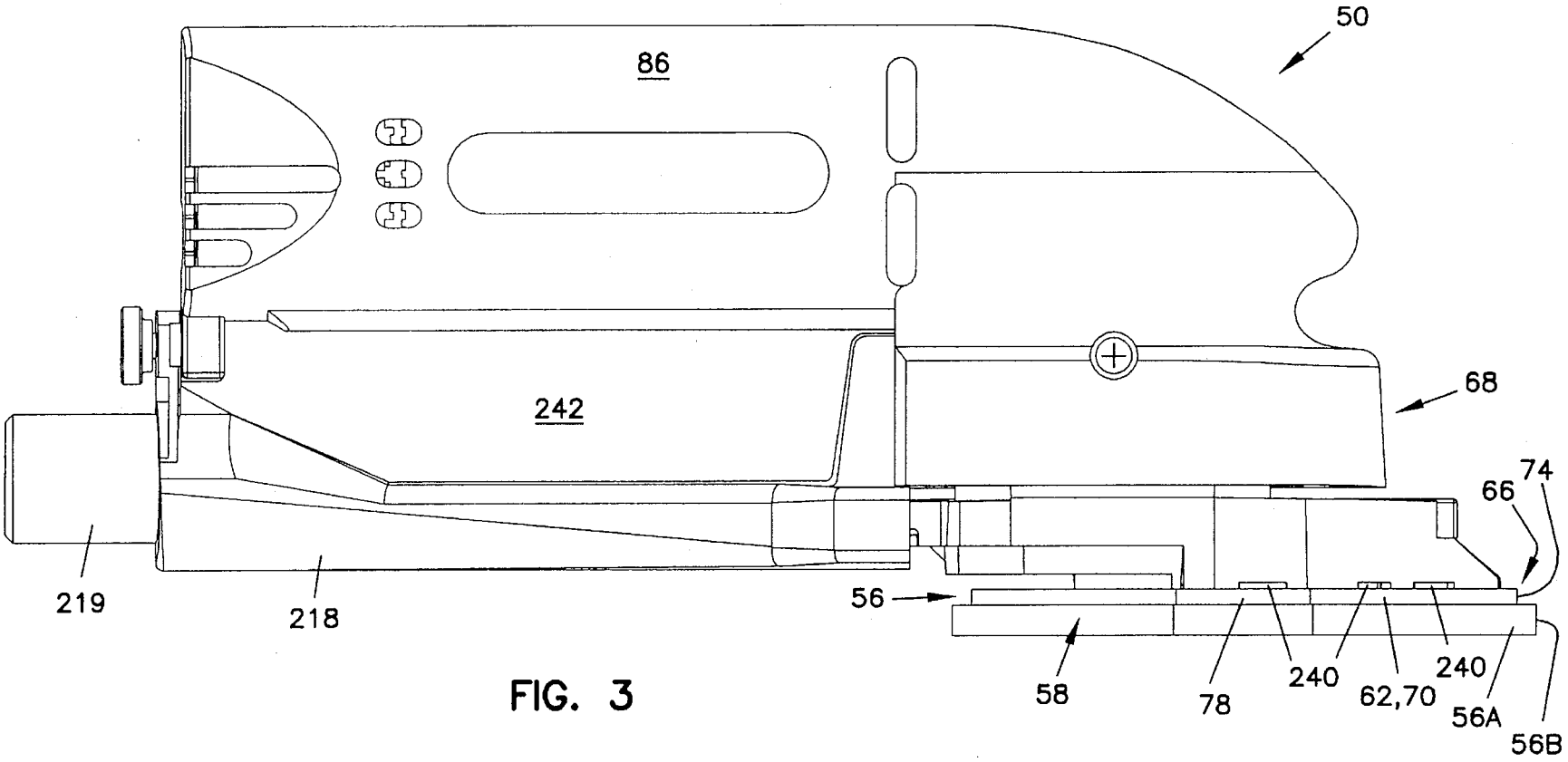
FIG. 3 illustrates a right side elevational view of the sander shown in FIG. 1.
Figure 5:
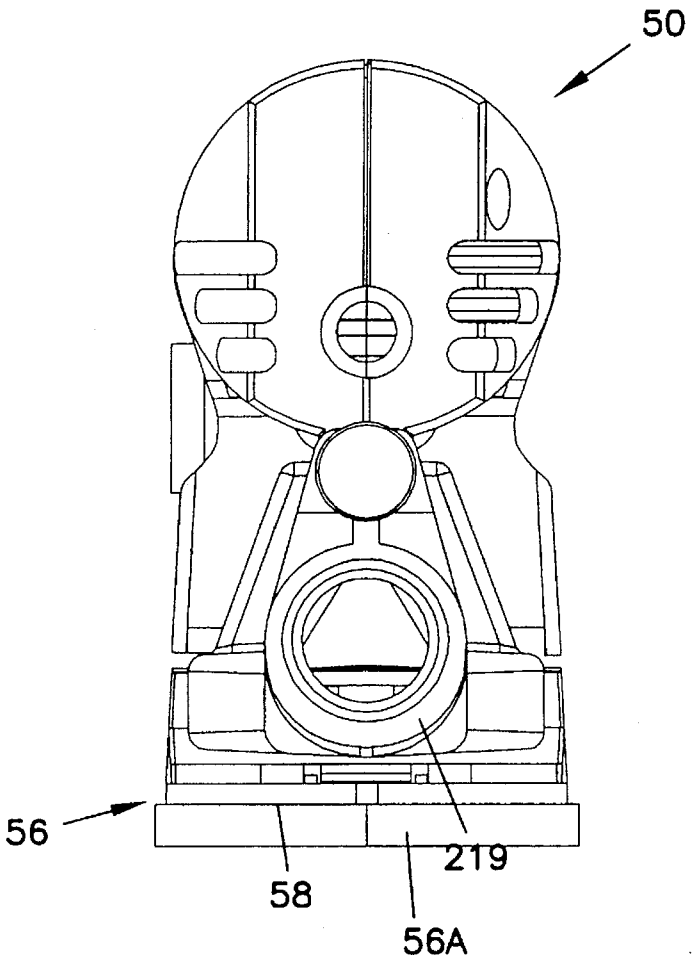
FIG. 5 illustrates a back elevational view of the sander shown in FIG. 1.
Figure 4:
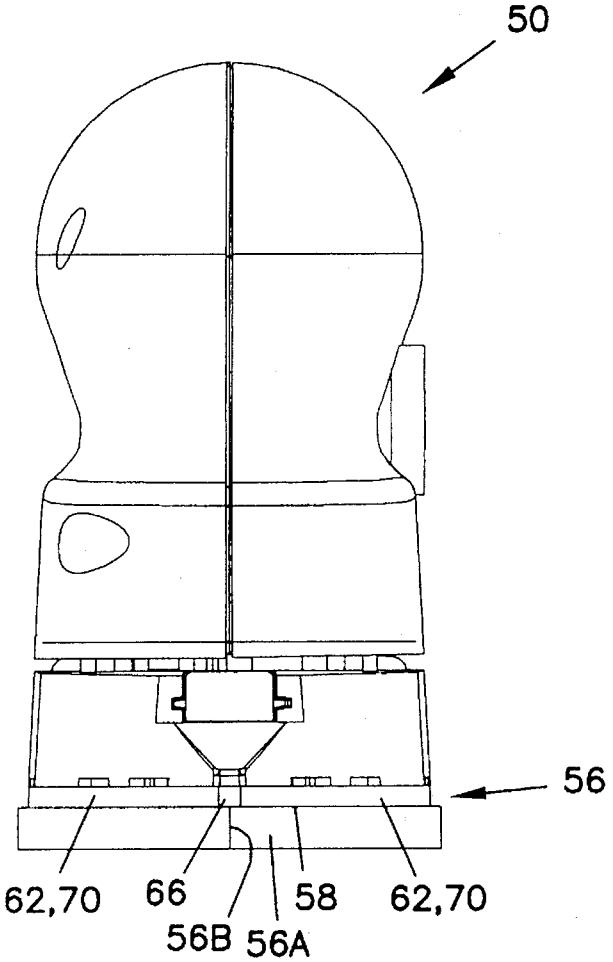
FIG. 4 illustrates a front elevational view of the sander shown in FIG. 1.

Although the tool or tool system referred to in the present application is referred to as a "sander" which uses "sandpaper", it will be recognized that other abrasive papers, abrasive materials, or abrasive systems or the like can be used to replace the "sandpaper" referred to without loss of generality.

The preferred system is a sanding system which can be configured into many highly-versatile configurations. The present sanding system is arranged and configured to alternatively and selectably accept for use a corner or detail pad, a shutter pad, and a wide variety of profiled pads. Such versatility is found in no other sander.

To accomplish this, the present sanding system preferably includes a pad frame system comprising a corner or detail pad frame for supporting a corner or detail pad for sanding into the corners of a caracas, a shutter pad frame for supporting a shutter pad configured for operations such as sanding louvers of a shutter blocked by other louvers on the shutter, and a profiled pad frame for supporting a profiled pad configured to power sand pre-configured profiles onto or sand such profiles previously configured on a workpiece.

The preferred sander comprises a sander body 50 which houses a motor 52 (see FIG. 8) coupled to an in-line oscillating mechanism 54.

A preferred sanding pad frame such as 56 or pad such as 56A may be coupled to an in-line oscillating mechanism such as 54 for movement in a linear oscillating motion. Such a sanding pad or pad frame, which is sometimes referred to in the present application as a corner or detail sanding pad or pad frame, typically has a substantially flat lower surface 58 and a substantially pointed front portion 60 bounded laterally by two substantially-linear corner-sanding edges 62 having an included angle 64 of less than 90 degrees.

A forward end 66 of the substantially pointed front portion 60 of preferred pad frame 56, and the forward end 56B of preferred pad 56A, protrudes ahead of a front end 68 of sander body 50 throughout the linear oscillating motion of pad frame 56.

The front portion 60 of preferred pad frame 56 and pad 56A has particular application for sanding into corners of a caracas. For example, with preferred pad frame 56 with pad 56A installed, when the sander is in use where three workpiece surfaces (not shown) of a caracas meet one another perpendicularly to form a corner, sandpaper supported by pad 56A under the forward portion 60 of the pad will effectively sand into the corner on any included surface of the corner.

Figure 25:
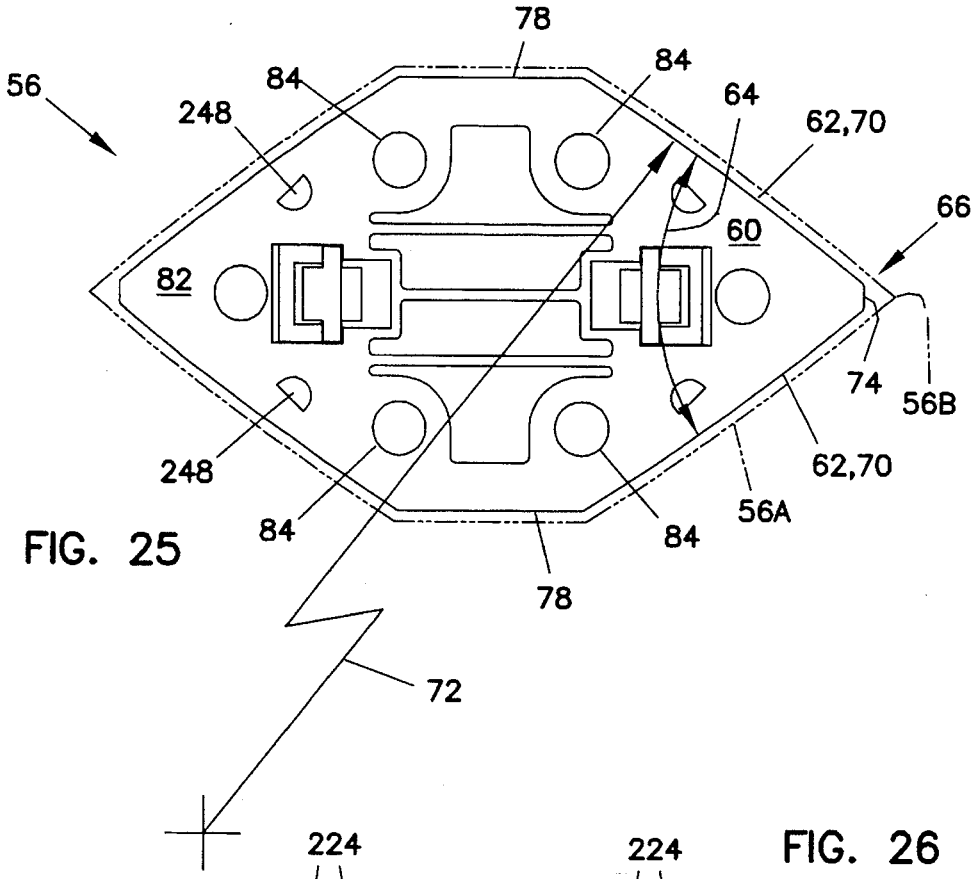
FIGS. 25, 25A, 26, and 27 illustrate the preferred corner or detail sanding pad frame and pad, including a preferred radius of an at least slightly-convex, curved sanding edge of the preferred corner or detail pad frame and pad.
Figure 26:
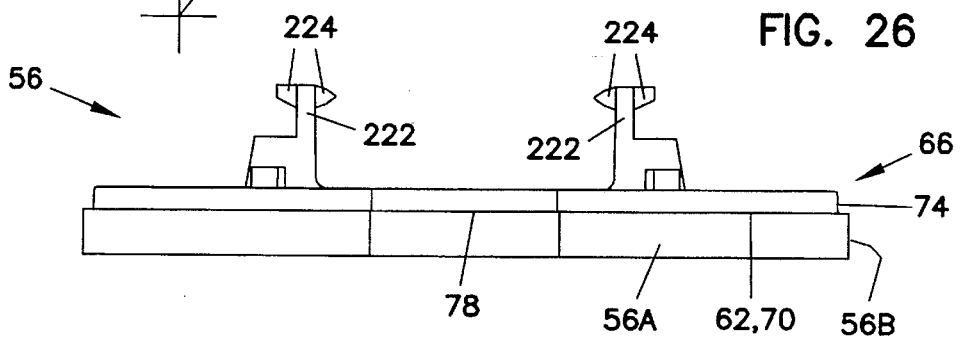
Figure 27:
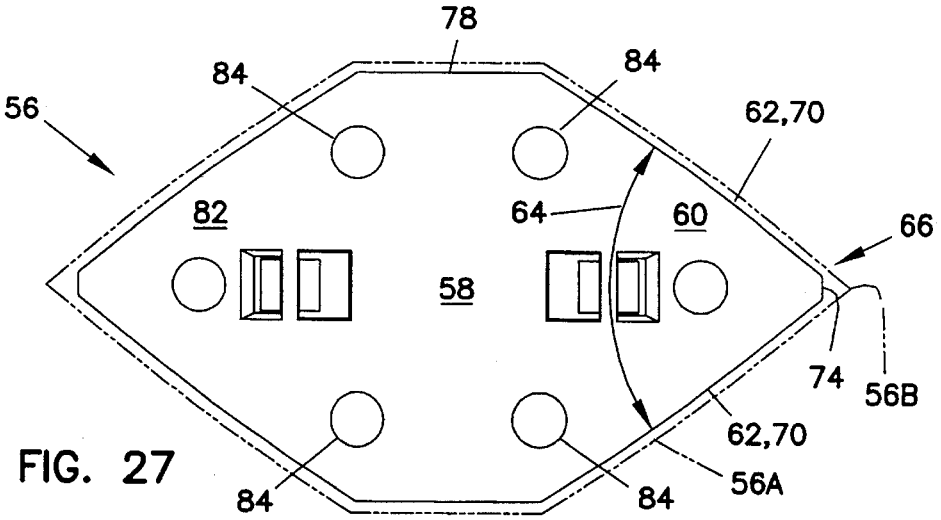

In a preferred embodiment, the substantially-linear corner-sanding edges 62 each define an at least slightly-convex, curved sanding edge 70. It has been found that a radius 72 (see FIG. 25) on the order of 15 inches is appropriate for defining the at least slightly-convex, curved sanding edges 70 and that such curved edges are useful when sanding into a corner. In such an application, the at least slightly-convex, curved sanding edges 70 facilitate a controlled rotation of the forward end 66 of the substantially pointed front portion 60 of the pad or pad frame into the corner.

Figure 25A:
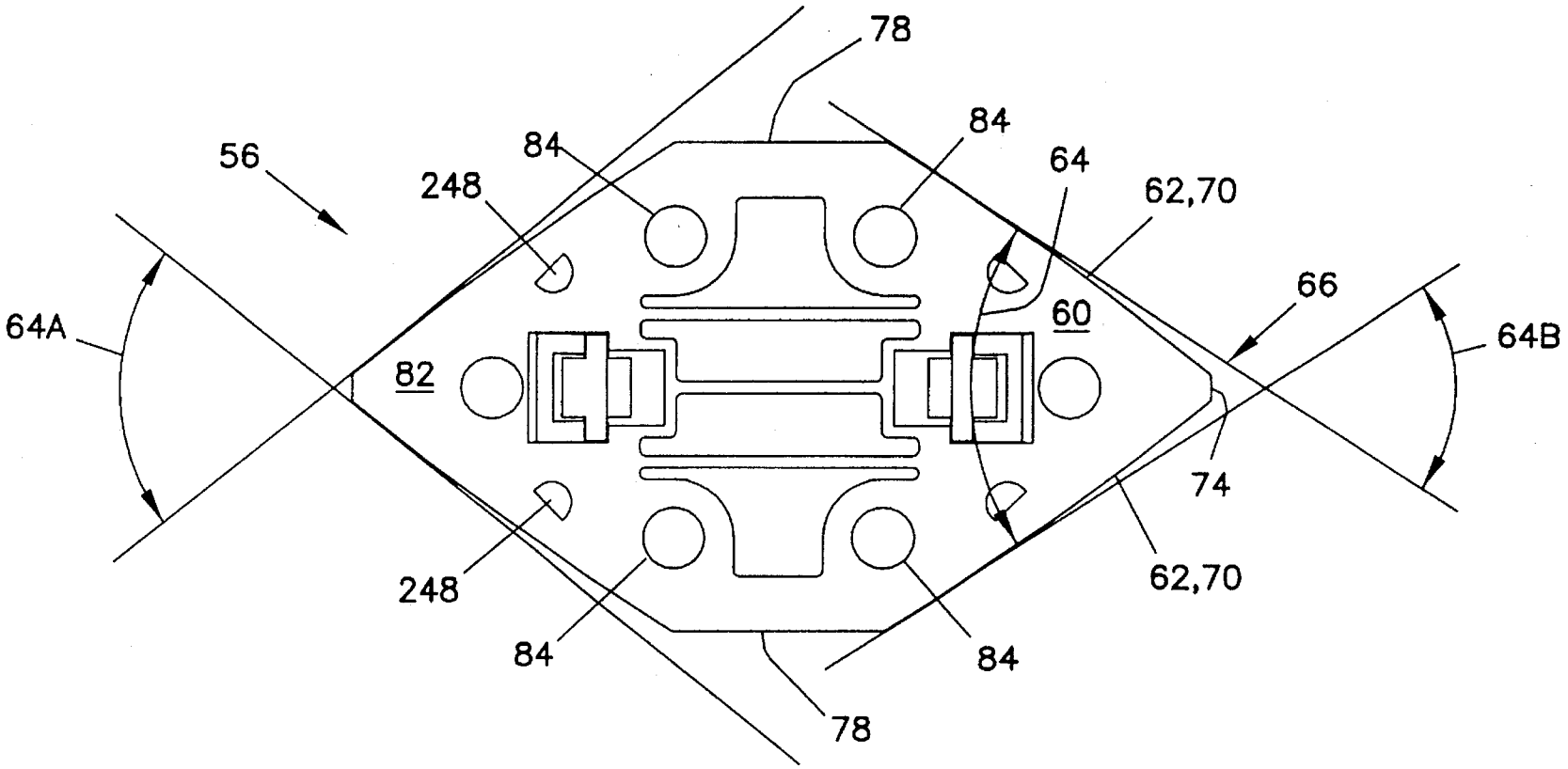
Figure 28:
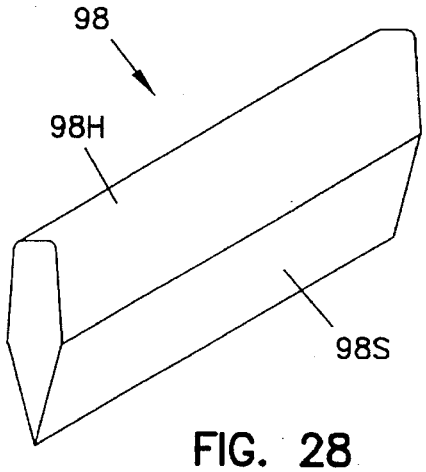
FIGS. 28–44 illustrate preferred profiled sanding pads which can be selectively used with the present sander.
Figure 29:
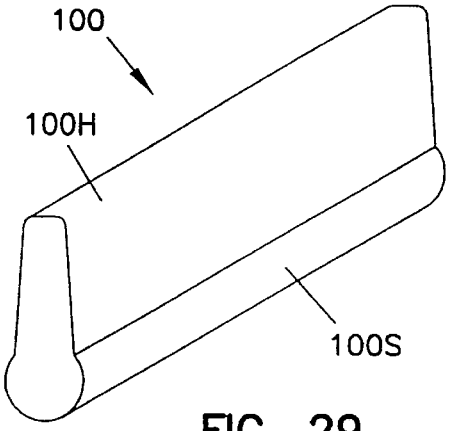
Figure 30:
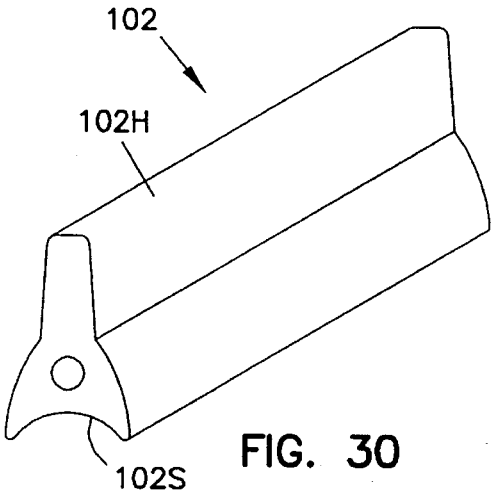
Figure 31:
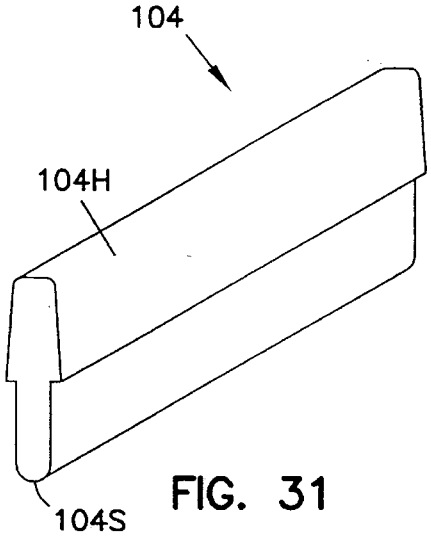
Figure 32:
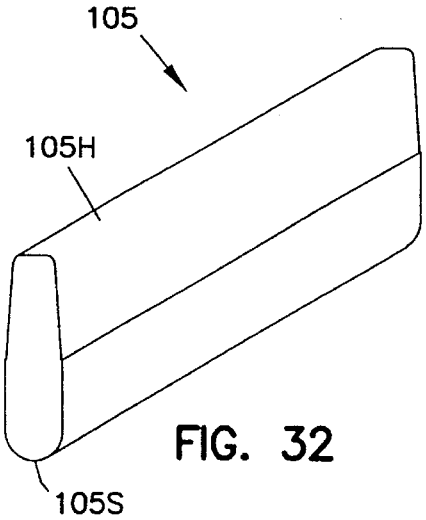
Figure 33:
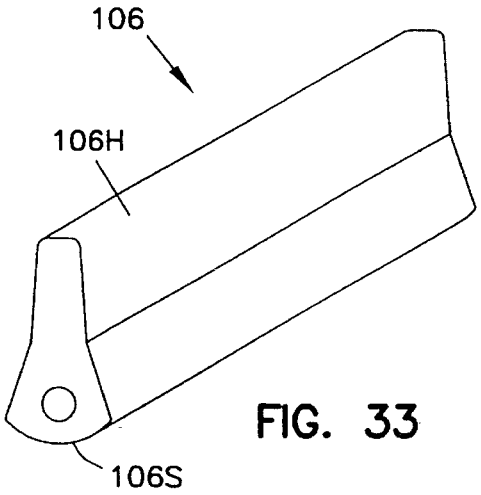
Figure 34:
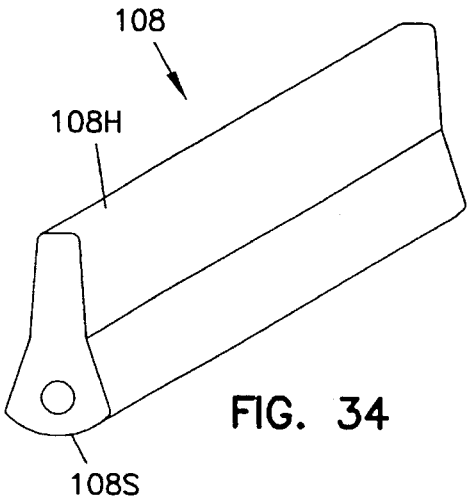
Figure 35:
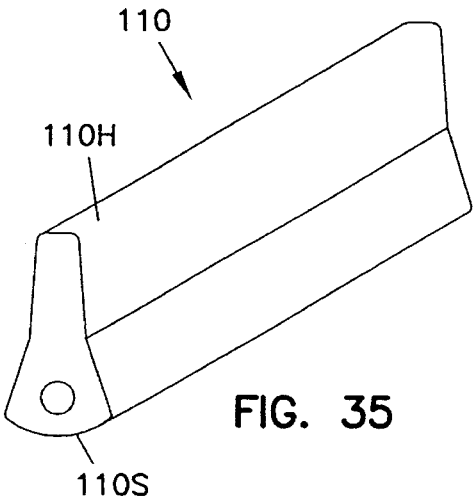
Figure 36:
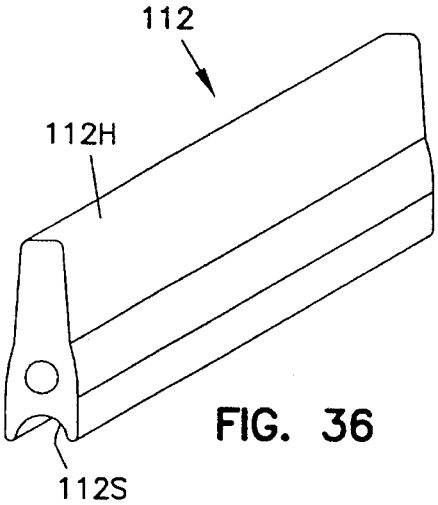
Figure 37:
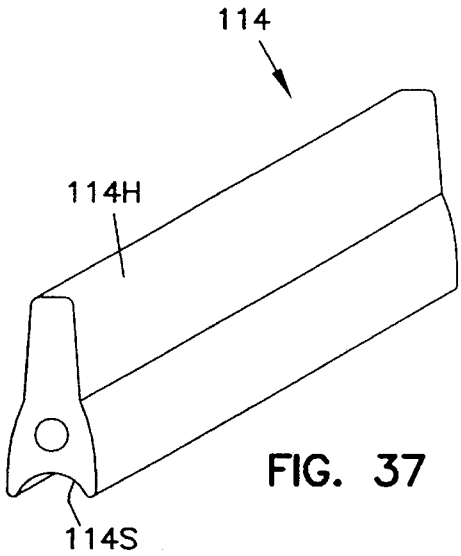
Figure 38:
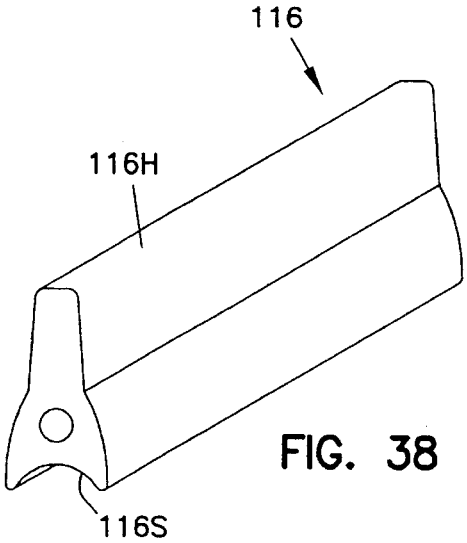
Figure 39:
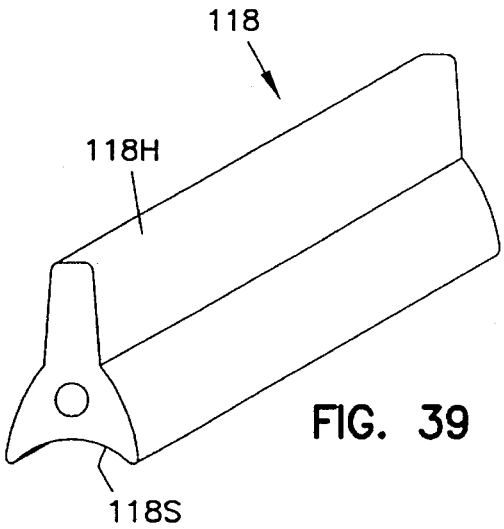
Figure 40:
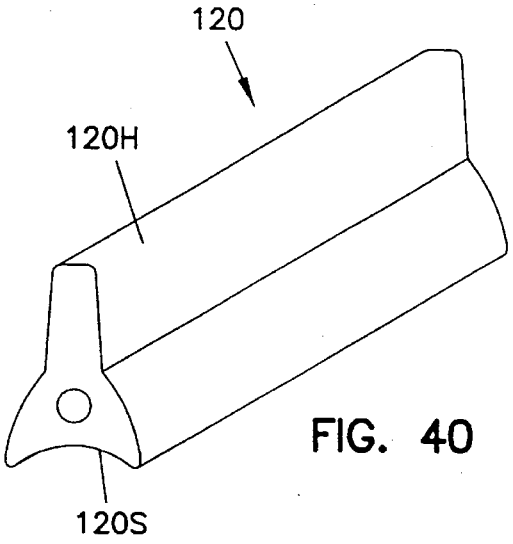
Figure 41:
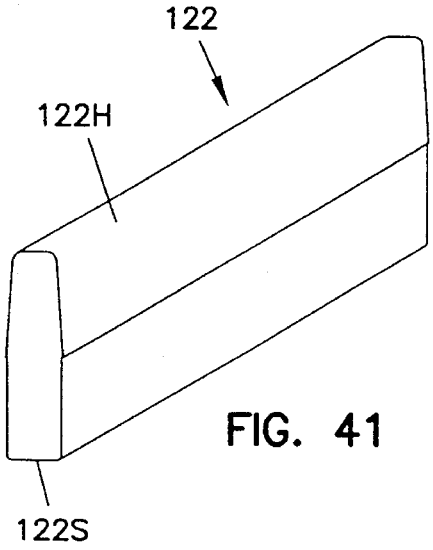
Figure 42:
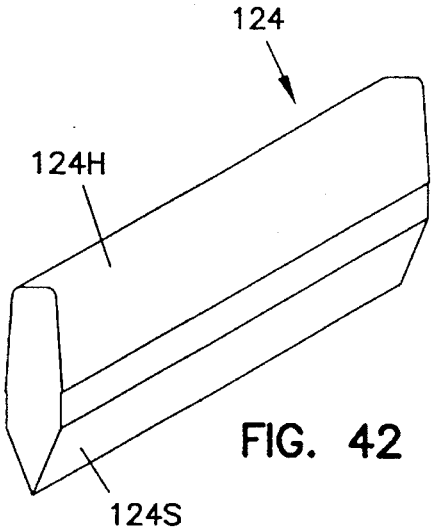
Figure 43:
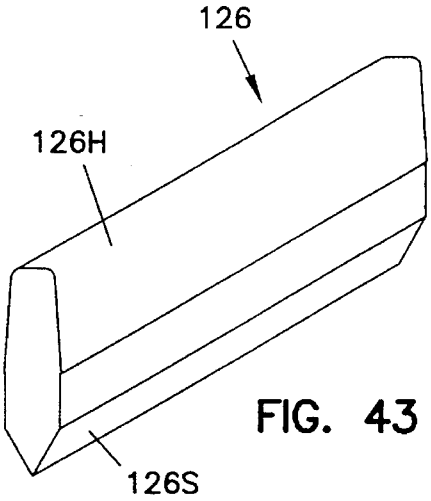
Figure 44:
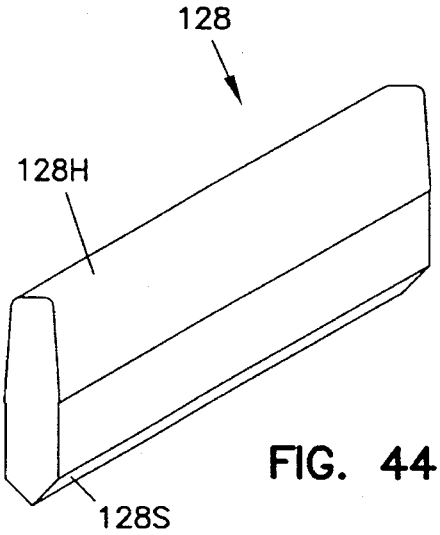

FIG. 25A further illustrates the preferred configuration of pad frame 56. At the forward end 66 of preferred pad frame 56, two tangents drawn along the at least slightly-convex, curved sanding edges 70 form an angle 64A of approximately 80 degrees. At the trailing edges of the substantially pointed front portion of preferred pad frame 56, tangents drawn along the at least slightly-convex, curved sanding edges 70 form an angle 64B of approximately 64 degrees. This preferred configuration assists in sanding within corners that are out of square. Sometimes nominally 90 degree corners in woodworking are off by plus or minus five degrees or even more. Accordingly, in order to sand into a corner that is closed by five degrees, the forward included angle of the pad should be less than 85 degrees. For this reason, preferred angle 64A shown in FIG. 25A was selected to be approximately 80 degrees, so that a corner of up to almost 80 degrees can be sanded. Furthermore, for corners having walls bowed in toward the user, an even smaller angle 64B of approximately 64 degrees was chosen, in order to allow rotation of forward end of the pad and pad frame into all portions of the corner.

Although the forward end 56B of preferred pad 56A is substantially pointed, forward end 66 of the substantially pointed front portion 60 of pad frame 56 preferably comprises a substantially flattened portion 74 joining the two sanding edges at the front end of the pad frame. When sanding into a corner, substantially flattened portion 74 of the substantially pointed front portion 60 of the pad frame helps prevent indenting of workpieces by the front end of the pad frame.

Figure 6:
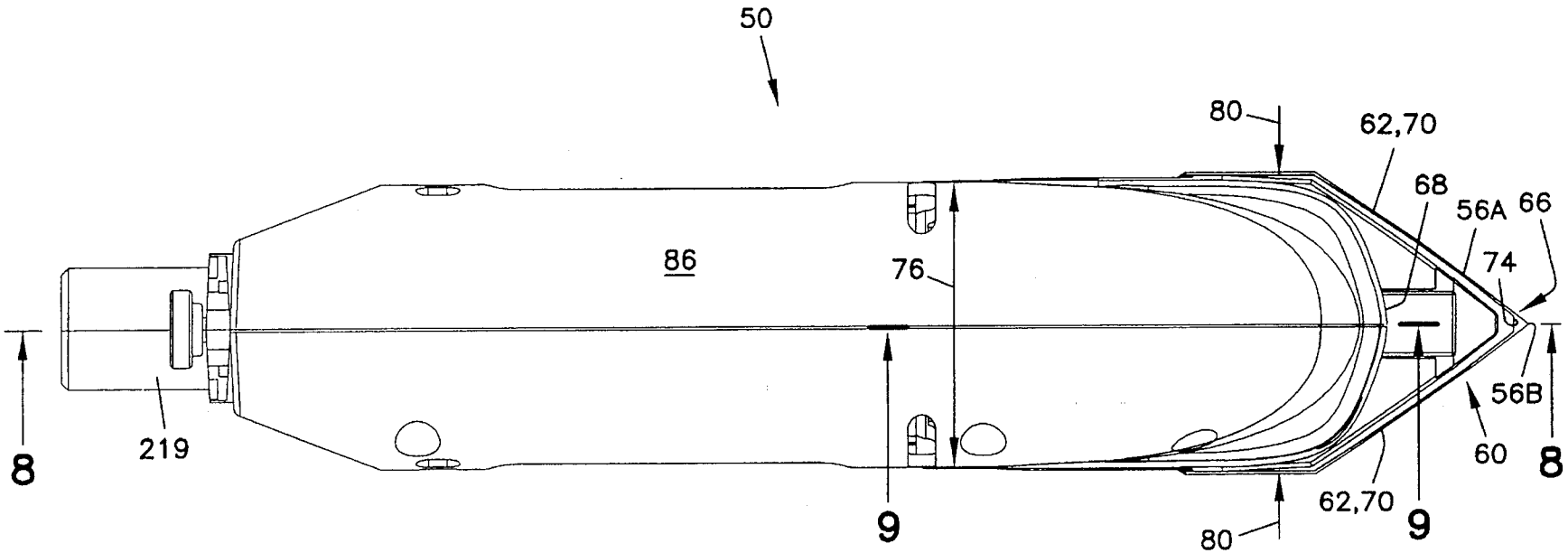
FIG. 6 illustrates a top plan view of the sander shown in FIG. 1.
Figure 7:
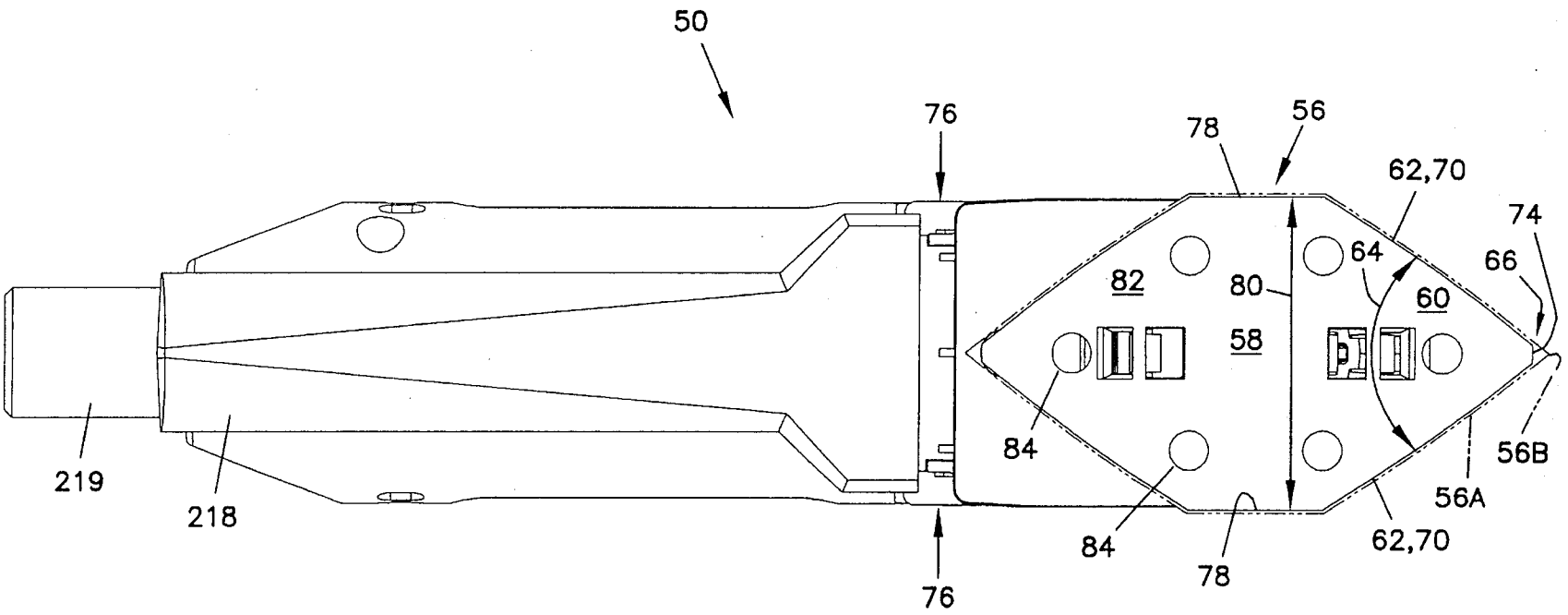
FIG. 7 illustrates a bottom plan view of the sander shown in FIG. 1, including a bottom plan view of a preferred corner or detail sanding frame (with a preferred corner or detail pad shown in phantom) for use with the present sander.

In the preferred embodiment, sander body 50 has a maximum width 76 (see FIGS. 6 and 7) on the order of 2.5 inches along the length of the sander body, and preferred pad frame 56 has at least one substantially linear side edge 78 which is aligned substantially parallel to the linear oscillating motion. In this preferred embodiment, the at least one substantially linear side edge 78 of pad frame 56 protrudes laterally at least as far as the maximum width 76 of sander body 50. With such a configuration, when the sander is in use where two workpiece surfaces (not shown) meet one another at an included angle along edges of less than 180 degrees, the surfaces of each workpiece which form the included angle can be sanded up to the adjoining workpiece surface by sandpaper supported by the pad under the at least one substantially linear side edge 78 of the pad frame. Preferred pad frame 56 has two substantially linear side edges 78 which are aligned substantially parallel to the linear oscillating motion. Each substantially linear side edge 78 of preferred pad frame 56 protrudes laterally at least as far as the maximum width 76 of the corresponding side of sander body 50. With such a configuration, when the sander is in use where two workpiece surfaces (not shown) meet one another at an included angle along edges of less than 180 degrees, the surfaces of each workpiece which form the included angle can be sanded up to the adjoining workpiece surface by sandpaper supported by the pad under either substantially linear side edge of the pad.

The substantially linear side edges of preferred pad 56A define a pad width 80 (see FIGS. 6 and 7) which is slightly larger than the maximum width 76 of the sander body. In the preferred embodiment, preferred pad frame 56 has a width of approximately 2.5 inches. With such a configuration, the sander can be effectively used on a workpiece surface (not shown) bounded by protruding workpiece surfaces (not shown) only slightly further apart than the maximum width of the sander body.

Preferred pad frame 56 further comprises a substantially pointed rear portion 82 bounded laterally by two substantially-linear corner-sanding edges having an included angle of less than 90 degrees. In the preferred embodiment, substantially pointed rear portion 82 is configured the same as preferred front portion 60, and preferred pad frame 56 is adapted and configured to be reversed end for end. With such a configuration, when sandpaper supported by the front end of the pad becomes worn, the pad frame can be reversed end for end so that the sandpaper at both substantially pointed portions of the pad or pad frame can be used easily and effectively.

When pad frame 56 is coupled to dust collection or vacuum housing 166, dust collected through ports 84 is carried through a dust channel 214 (see FIGS. 8 and 14) to a dust exhaust channel 216 (see FIG. 8) within dust exhaust housing 218 for collecting dust generated by sandpaper coupled to lower surface 58 of frame 56A.

In the preferred system, vacuum housing 166 defines the upper portion of dust channel 214 within housing 166, the lower portion of vacuum housing being formed by the combination of a vacuum housing cover 244 (see FIGS. 12 and 13) held in place by a machine screw 246, and by the upper surface of any pad frame coupled to the lower surface of housing 166.

In addition to dust collection through dust ports 84 located through some versions of pad frames and pads (see, for example, dust ports 84 in FIGS. 7, 12, 13, and 18), additional dust collection capability is also available in the preferred system. The preferred system comprises a sander vacuum housing 166 and pad frame system which provides unique, continuous air flow for dust collection in a sander coupled to a dust collection system such as a separate vacuum cleaner or dust collector (not shown), while providing the versatility of using a pad frame system. This continuous air flow providing the additional dust collection capability of the preferred system is effective independently of whether dust ports such as 84 are located through the thickness of pad frames or pads. In addition, the continuous air flow of the preferred system helps ensure that dust which passes into dust channel 214 or dust exhaust channel 216 or a collection hose does not stagnate or unduly collect in or block such passages.

Furthermore, the preferred dust collection system helps prevent a pad with dust ports such as 84 located through the thickness of the pad frames or pads from essentially adhering to a workpiece surface. Such a workpiece surface adherence could otherwise occur through the substantial partial vacuum that is created by an effective external vacuum cleaner or dust collector. However, the continuous dust-collection air flow of the preferred system substantially eliminates such an adherence of pads to a workpiece surface.

The preferred dust collection system has particular application to a pad frame system for supporting sanding pads having varying characteristics or geometries, but it is not limited to such a system of pad frames, nor is it limited to in-line sanding systems. For example, the preferred dust collection system has application to corner or detail sanding systems which employ rotationally-oscillating, pivoting, or orbital sanding motions.

The preferred dust collection system comprises a vacuum housing such as housing 166 adapted and configured to be coupled to a motorized sanding mechanism of a sander so that the vacuum housing moves in a sanding motion. In one preferred embodiment, the vacuum housing defines at least the upper portion of a dust channel such as dust collection channel 214 within the housing. The dust channel in the vacuum housing is adapted and configured for connection to a dust collection system.

Figure 12:
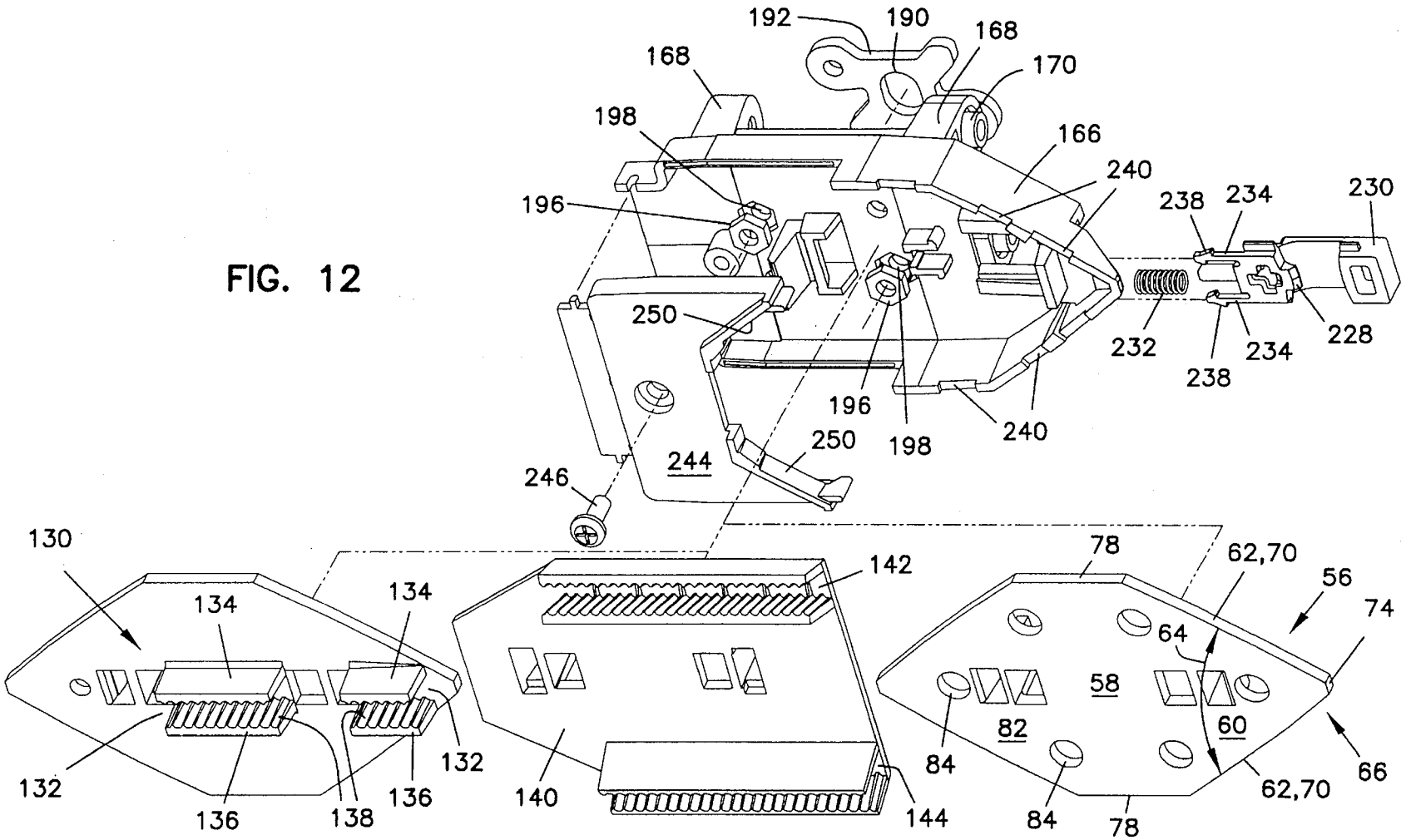
FIG. 12 is an exploded lower perspective view including a lower perspective view of two alternate preferred profiled pad frames for respectively holding a single or two profiled pads, as well as of a preferred corner or detail pad frame.
Figure 18:
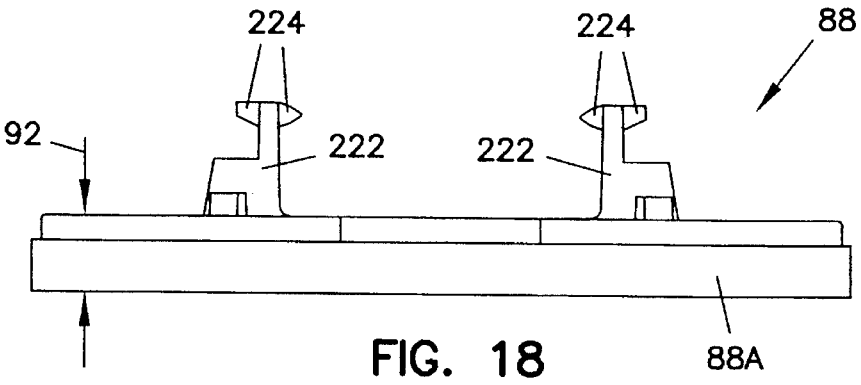
Figure 21:
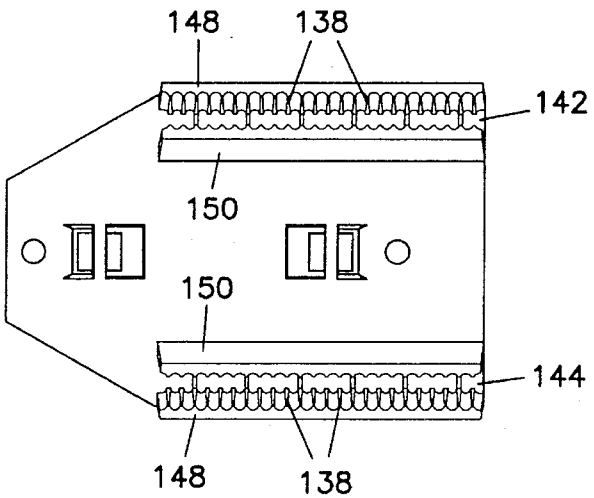
FIGS. 19–21 illustrate a preferred pad frame for holding two profiled pads.
Figure 20:
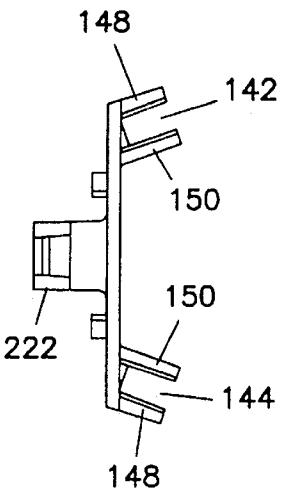
Figure 19:
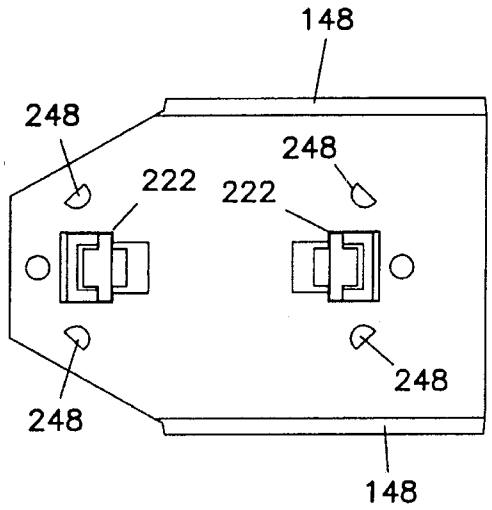
Figure 22:
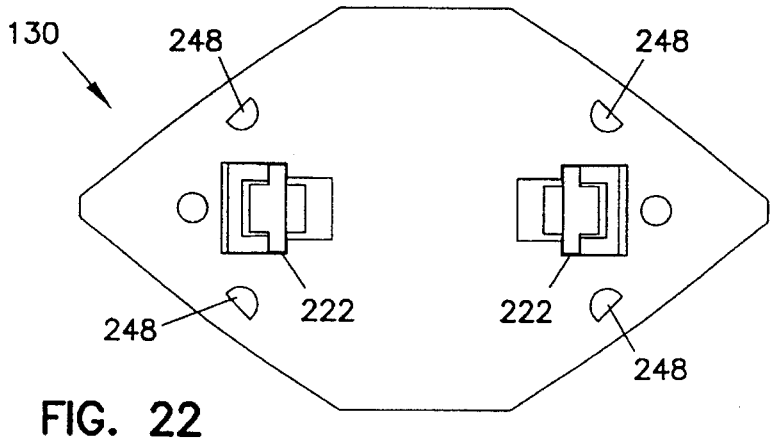
FIGS. 22–24 illustrate a preferred pad frame for holding a single profiled sanding pad.
Figure 23:
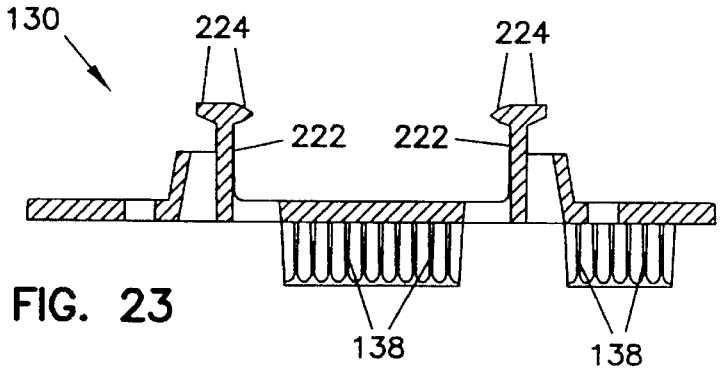
Figure 24:
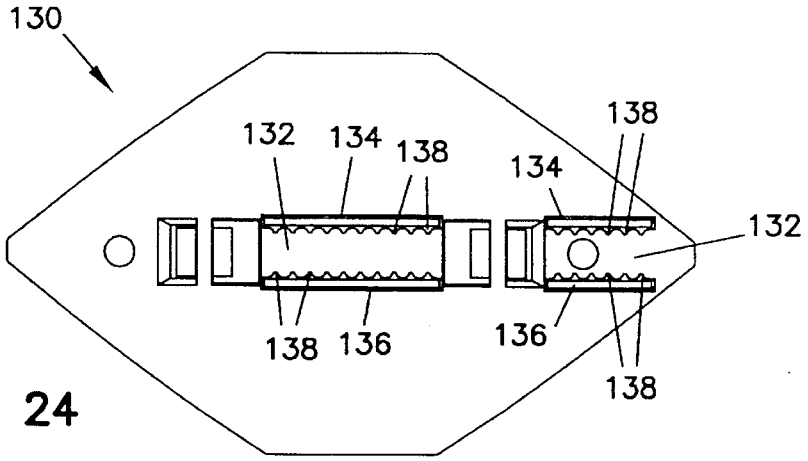

The preferred dust collection system further comprises a pad frame (e.g., a pad frame such as frame 56 described above, or pad frames such as 88, 130, or 140, described below; see, for example, FIGS. 12 and 18) arranged and configured to be coupled under the vacuum housing in order to move the lower surface of an attached frame so coupled in a sanding motion. The pad frame comprises a relatively soft sanding pad, described below, for supporting sandpaper.

The preferred dust collection system comprises a vacuum housing which defines air flow dust ports 240 proximate the upper surface of the attached pad frame in a lower portion of the vacuum housing. Air flow dust ports such as 240 permit a continuous flow of air during dust collection from a region outside the vacuum housing proximate the upper surface of the attached pad frame, through a vacuum housing dust channel such as 214, and to the separate vacuum cleaner or dust collector.

With the preferred dust collection system, airborne dust proximate air flow dust ports such as 240 will be drawn continuously into the separate vacuum cleaner or dust collector.

In alternate embodiments (not shown), dust ports such as 240 could be formed or defined entirely by a lower portion of a vacuum housing such as 166 (e.g., by apertures defined completely by the housing proximate the upper portion of a pad frame or pad), or dust ports such as 240 could be defined by portions of the upper surface of a pad frame or pad adjacent a lower portion of a vacuum housing.

Preferred sander body 50 comprises a substantially barrel-shaped portion 86. The barrel-shaped portion of preferred sander body 50 has a diameter substantially equal to or less than the maximum width 76 of the sander body, so that the barrel-shaped portion of the sander body is adapted and configured to be grasped by a user's hand. As is explained further below, dust exhaust housing 218 may be optionally removed. With dust exhaust housing 218 in place, a user's fingers can wrap around barrel-shaped portion 86, and fit within a opening 242 located between barrel-shaped portion 86 and dust exhaust housing 218.

Figure 17:
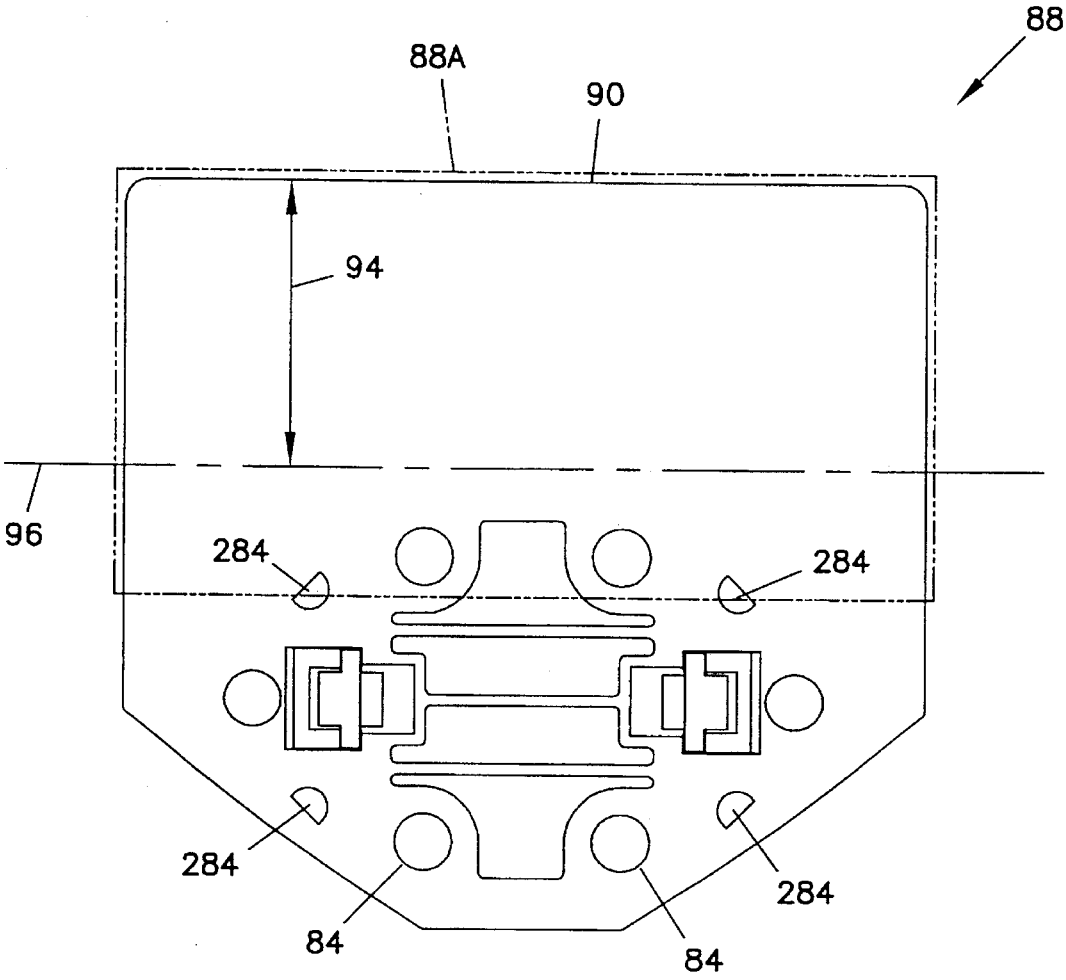
FIGS. 17 and 18 illustrate a preferred shutter pad frame and pad.

An alternate preferred sanding pad or pad frame useful with the present sander or sanding system is sometimes referred to in the present application as a shutter pad or pad frame. FIGS. 17 and 18 illustrate a preferred shutter pad frame 88 and pad 88A, which has at least one extended substantially linear side edge 90 which is aligned substantially parallel to the linear oscillating motion and which extends laterally a conspicuous distance 94 beyond the maximum width of the sander body. In FIG. 17, line 96 represents a top plan view projection of the maximum width of sander body 50 projected onto preferred pad frame 88 in order to illustrate the conspicuous distance 94 beyond the maximum width of the sander body that preferred pad frame 88 extends. With such a configuration, when the sander is in use on a project such the louvers on a shutter (not shown), where a lower workpiece upper surface (not shown) is below an upper workpiece (not shown) by a distance greater than a thickness 92 of the shutter pad and pad assembly but is inaccessible by the sander body, sandpaper supported by the pad below the at least one extended substantially linear side edge can be effectively used on the inaccessible lower workpiece upper surface within the conspicuous distance 94 that the at least one extended substantially linear side edge 90 protrudes laterally beyond the sander body.

In the preferred embodiment shown in FIG. 17, distance 94 is approximately 1.6 inches. Other distances 94 could also be used. In addition, a similar shutter pad or pad frame could have two extended substantially linear side edges each protruding laterally a conspicuous distance beyond each side of the sander body.

As with preferred pad frame 56, preferred sanding pad frame 88 defines dust ports 84 (see FIG. 17). When pad frame 88 is coupled to dust collection housing 166, dust collected through ports 84 is carried through a dust channel 214 (see FIGS. 8 and 14) to a dust exhaust channel 216 (see FIG. 8) within dust exhaust housing 218 for collecting dust generated by sandpaper coupled to the lower surface of pad 88A.

Preferred substantially flat portions of corner or detail pad frame 56 and preferred shutter pad frame 88 have a nominal thickness 92 (see FIG. 18) of approximately 0.125 inch, although other thicknesses could be used.

Pad frames such as 56, 88, 130, and 140 typically comprise or are formed of a relatively hard, structural material. For example, such pad frames can be formed of ABS polycarbonite plastic.

Pads such as 56A and 88A may be attached to frames such as 56 and 88 by a cross-linked acrylic pressure sensitive adhesive (PA). The pads may comprise either a substantially flat lower surface adapted to secure sandpaper or the like to the bottom of the pads with releasable pressure sensitive adhesive (such that the pads might be referred to as PA pads), or the lower surface of the pads such as 56A and 88A may comprise a hook and loop system (such that the associated pads might be referred to as hook and loop pads).

PA pads may be formed of neoprene foam rubber having a thickness of, for example, 0.25 inch. The upper portion of hook and loop pads may be formed of mini-cell urethane having a thickness, for example of 0.20 inch. Other systems for securing an abrasive surface or the like to the pads or pad frames could also be used.

In the preferred sanding system, profiled sanding pads such as pads 98–128 (see FIGS. 28–44) are adapted and configured to be coupled to the in-line oscillating mechanism. Each profiled sanding pad 98–128 has, in a plane substantially perpendicular to the linear oscillating motion, a particular cross sectional profile corresponding to a profile to be formed onto or to be sanded on a workpiece. The cross sectional configuration typically extends substantially consistently along the entire length of the profiled pad. Pads 98–128 respectively define sanding surfaces 98S–128S, with each such sanding surface having a profile corresponding to the particular cross sectional profile desired. With such a system, sandpaper secured to the sanding surface of a profiled sanding pad will power sand the selected profile to be formed onto or to be sanded on a workpiece (cross sectional profiles in addition to those shown in FIGS. 28–44 may be employed, and any such configurations may include or be used to sand or form profiles commonly formed onto or to be sanded on a workpiece, as well as those not commonly formed or sanded).

Profiled pads such as pads 98–128 may be formed of nitrile butadiene rubber (NBR) having a nominal hardness of 80 on the shore scale. Other materials and hardness may also be employed. Varying hardness can affect the amount of material removed by the pads. Sandpaper can be secured to such pads using pressure sensitive or other adhesives, or other approaches might be used to secure abrasive to the sanding surfaces of pads 98–128.

Preferred profiled pads such as pads 98–128 for use with the present system may have a length of approximately 2.75 inches, although pads in other lengths may be configured as needs dictate.

Preferred in-line oscillating mechanism 54 is adapted and configured to selectively receive and move in a linear oscillating motion at least one of a plurality of profiled sanding pads selectable from a system of profiled sanding pads, and a preferred sander comprises a system of profiled sanding pads such as pads 98–128. Each profiled sanding pad within the system is adapted and configured to be selectively coupled to in-line oscillating mechanism 54, and each profiled sanding pad has, in a plane substantially perpendicular to the linear oscillating motion, a distinct particular cross sectional profile corresponding to a profile to be formed onto or to be sanded on a workpiece. The cross sectional configuration of any profiled pad in the system typically extends substantially consistently along the length of the pad, and each profiled pad in the system defines a sanding surface 98S–128S having a profile corresponding to the distinct particular cross sectional profile of the pad. With such a system, sandpaper secured to the sanding surface of any profiled pad in the system will, when the corresponding pad is coupled to in-line oscillating mechanism 54, power sand the profile having the distinct particular cross section of the selected pad.

In the preferred sanding system, in-line oscillating mechanism 54 is adapted and configured to move in a linear oscillating motion a plurality of profiled sanding pads selected from the system of profiled sanding pads. In this embodiment, the selected pads are typically coupled at spaced-apart locations onto the in-line oscillating mechanism. With such an arrangement, sandpaper secured to the sanding surfaces of the profiled pads will, when the selected plurality pads are coupled to the in-line oscillating mechanism, selectively and alternately power sand onto the workpiece the profiles having the distinct particular cross sections of the selected plurality of pads secured to the in-line oscillating mechanism.

The preferred sanding system comprises a variety of pad frames adapted and configured to be coupled to in-line oscillating mechanism 54. In the preferred embodiment, this is accomplished through a vacuum housing 166 which is coupled to the in-line oscillating mechanism 54, and vacuum housing 166, which moves in linear oscillating motion, is adapted and configured to be selectively coupled to a plurality of sanding pads frames such as corner or detail pad frame 56, shutter pad frame 88, or profiled pad frames 130 or 140, which in turn are adapted and configured to position one or more profiled pads 98–128 for in-line power sanding. With such a system, the present sander or sanding system can be alternately and selectively adapted and configured as either a power corner or detail sander, a power shutter sander, or a power profile sander.

Figure 9:
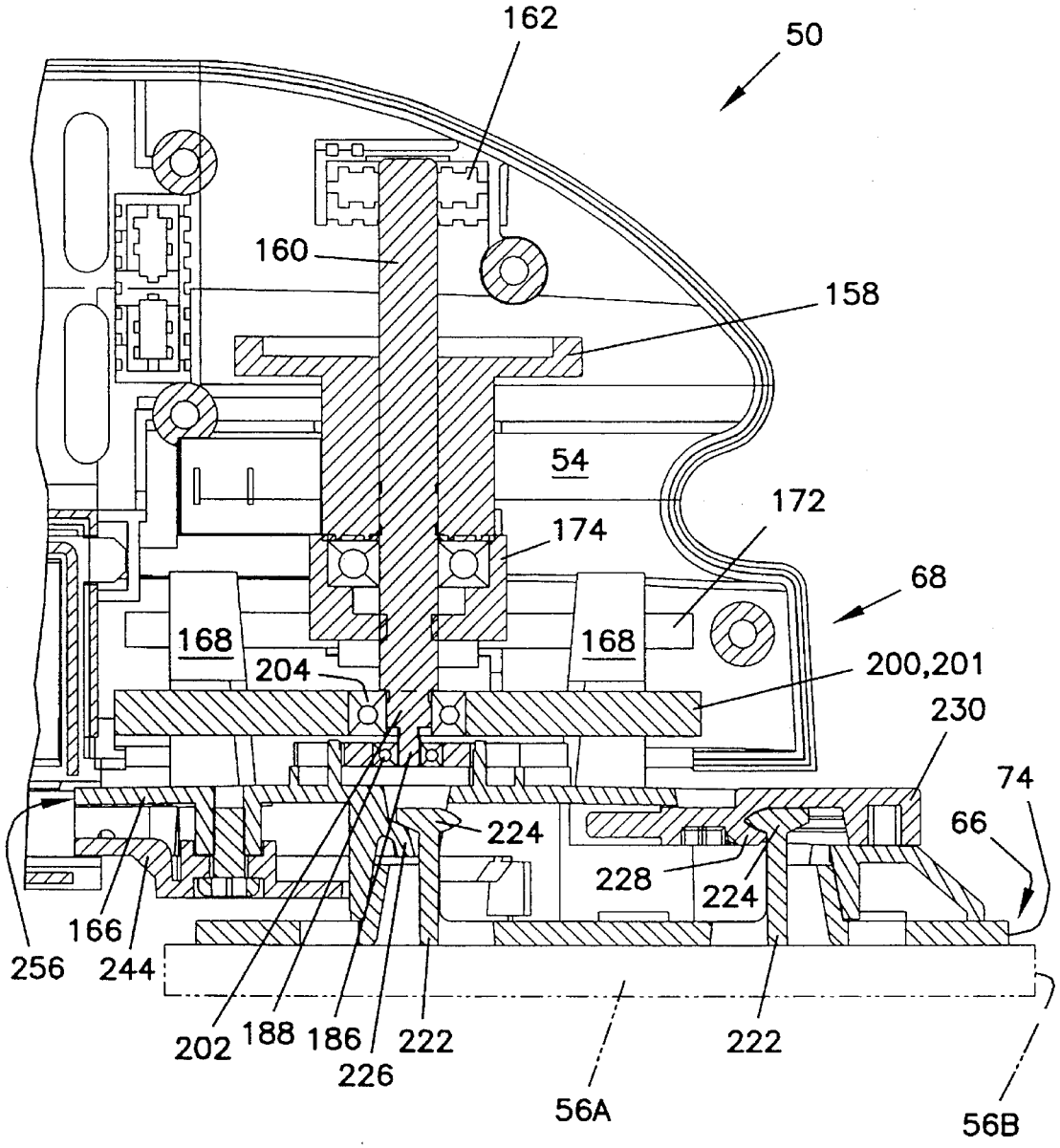
FIG. 9 is a right side elevational cross section of a front portion of the sander (taken along cutting line 9—9 of FIG. 6) showing a portion of the preferred in-line oscillation system as well as a preferred corner or detail sanding pad coupled to the sander.

Pads or pad frames such as 56, 130, and 140 are adapted and configured in the preferred embodiment to be selectively and conveniently connected to in-line oscillating mechanism 54 by snapping the pad frames into the lower portion of vacuum housing 166. Each of preferred pad frames 56, 130, and 140 comprise two in-line, upwardly-protruding vertical members 222 having at their upper ends forward and back facing hooked portions 224 which are secured within vacuum housing 166 by fixed or moveable flanges. A rear-facing, hooked portion 224 on a rear vertical member 222 on each pad frame engages with a forward-facing, fixed flange 226 (see FIG. 9) formed within vacuum housing 166. A forward facing hooked portion 224 on a front vertical member on each pad frame engages a moveable, forward-facing flange 228 (see FIGS. 9 and 12) located on the underside of a releasable sliding or locking button 230.

Releasable sliding button 230 is biased by a spring 232, and is releasably secured into a front upper portion of vacuum housing 166 by biased, sliding side portions 234 on button 230, the biased, sliding side portions 234 being received by grooves 236 defined by the opening formed into the front upper portion of the vacuum housing for receiving button 230.

Hooked members 238 formed on the ends of biased, sliding side portions 234 of button 230 maintain the button in a normal, installed position within vacuum housing 166. Button 230 can be removed for replacement or the like by pulling the button outward while simultaneously pushing the biased, sliding side portions 234 toward one another in order to release hooked members 238 from grooves 236.

In normal operation of button 230 for releasing or more easily installing a sanding pad frame, button 230 is pushed into the vacuum housing. This inward movement of button 230 releases front-facing, movable flange 228 within button 230 away from rear-facing hook 224 on the front vertical member 222 of any preferred sanding pad frame, thus allowing removal of the pad frame from vacuum housing 166. Such removal is facilitated by moving the pad frame simultaneously slightly forward and downward, in order to also release the rear facing hook 224 on the rear vertical member 222 of the pad frame frontward and downward away from forward facing permanent flange 226, thus releasing the pad frame.

A new pad frame can be inserted onto vacuum housing 166 by simply inserting the pad frame vertical members 222 up into the vacuum housing so that the rear facing hook 224 on the rear vertical member 222 engages forward facing, permanently-placed flange 226, while engaging the rear-facing hook 224 on the front vertical member 222 up and into the movable front-facing flange 228 on releasable spring-biased button 230.

In addition to being secured by vertical members 222 as described above, preferred pad frames 56, 88, 130, and 140 each comprise four stability projection members 248. In the preferred embodiment, two of stability projection members 248 are located toward the front portion of each pad frame and bear snugly up against the inside of the front interior walls of vacuum housing 166, and two of the stability projection members 248 are located toward the rear portion of each pad frame and bear snugly up against vacuum housing cover 244 bearing surfaces 250, which are geometrically symmetrical to the front interior walls of vacuum housing 166. This snug interface between projection members 248 and the interior side of the front walls of vacuum housing 166 and bearing surfaces 250 substantially eliminate in-line movement of the pad frames or pads with respect to the vacuum housing.

One profiled pad holding system 130 (see, for example, FIGS. 10, 12, and 22–24) useful with the present sanding system is adapted and configured to hold a single profiled sanding pad such as any one of pads 98–128. In the preferred system, pads 98–128 have an upper portion defining a particular holding cross sectional configuration 98H–128H preferably extending substantially consistently along the length of the pad. Preferred holding system 130 defines a single, substantially downward-facing channel 132 having first and second sides 134 and 136 respectively configured to secure any one of holding cross sectional configurations 98H–128H of the profiled pads.

Preferred profiled sanding pad holding system 130 further defines substantially-vertically-oriented ridges 138 on the inner surfaces of sidewalls 134 and 136 of substantially downward-facing channel 132 to assist in securing the holding cross sectional configurations of the profiled pads. It has been found that ridges 138 may be configured with a 0.015 inch flat on the tip of the ridges, and each ridge has concave radial sides. Other configurations could also be used. In addition, different arrangements entirely could be used, e.g., a T-slot configuration.

Profiled sanding pad holding system 130 preferably is further arranged and configured so that, when the profiled sanding pad is coupled to the in-line oscillating mechanism, at least a portion of the particular cross sectional profile 131 (see, for example, FIG. 8) protrudes ahead of front end 68 of the sander body throughout the linear oscillating motion of the pad. With such an arrangement, when sandpaper is secured to at least the portion 131 of the particular cross sectional profile which protrudes ahead of the front end of the sander body throughout the linear oscillating motion of the pad, the protruding portion can be used to power sand the profile to be formed onto or to be sanded on a workpiece on a surface which is otherwise blocked from access by the sander body.

An alternate profiled sanding pad holding system 140 (see FIGS. 12 and 19–21) defines two substantially downward-facing channels 142 and 144. In the preferred embodiment, each channel 142 and 144 comprises first and second sidewalls 148 and 150 aligned lengthwise in-line with the linear oscillating motion. Sidewalls 148 and 150 are configured to secure the holding cross sectional configurations of the profiled pads. As with channel 132, channels 142 and 144 preferably comprise substantially-vertically-oriented ridges 138 on the inner surfaces of sidewalls 148 and 150 to assist in securing the holding cross sectional configurations of the profiled pads in the channels.

Figure 10:
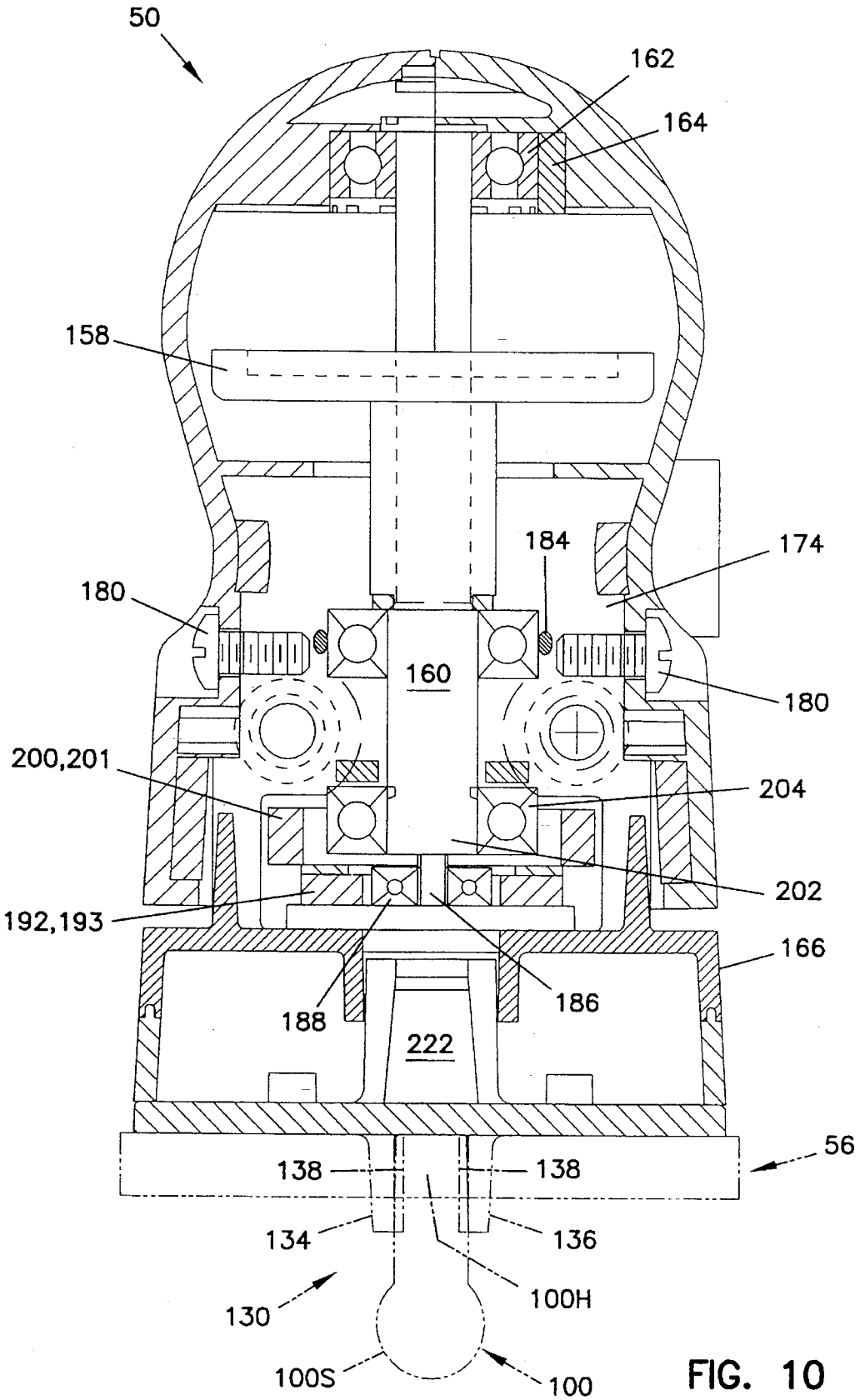
FIG. 10 is a front cross sectional view (taken along cutting line 10—10 of FIG. 8) including a preferred holding system adapted and configured for holding a single, selected profiled sanding pad.
Figure 10A:
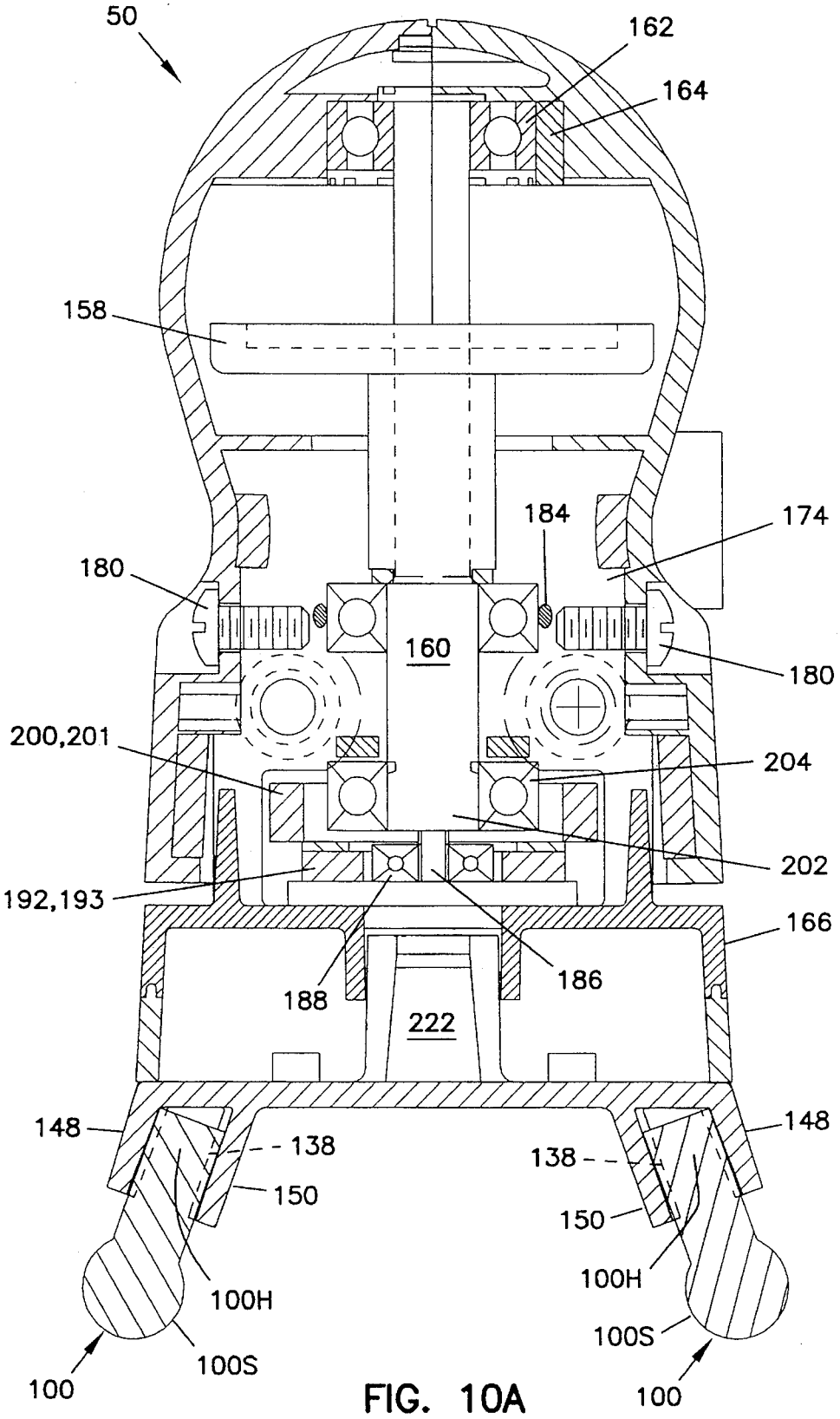
FIG. 10A is a front cross sectional view (taken along cutting line 10A—10A of FIG. 8) including a preferred holding system adapted and configured for holding two selected profiled sanding pads.

In the preferred configuration of alternate profiled sanding pad holding system 140 (see FIGS. 10A, 12, and 19–21), the two substantially downward-facing channels 142 and 144 are each angled at least slightly outward from one another and are located so that any of the preferred profiled sanding pads 98–128 secured within either of the two channels has at least a portion of the pad sanding surface projecting laterally past the sander body maximum width (see FIG. 10A). Using the profiled sanding pad orientation achieved through preferred alternate pad holding system 140, with sandpaper secured to the sanding surfaces of selected pads mounted in channels 142 and 144, at least a portion of selected particular cross sectional profiles can with power sanding be formed onto or sanded on a workpiece surface that might otherwise be blocked by the sander body.

It is further preferred that the configuration of alternate profiled sanding pad holding system 140 comprise the two substantially downward-facing channels each being located such that any profiled sanding pad secured within either of the two channels may be positioned so that at least a portion of the pad sanding surface protrudes ahead of the front end of the sander body throughout the linear oscillating motion of the pad. This is accomplished through placement of the forward end of channels 142 and 144 as far forward on holding system 140 as the forward end of channel 132 is placed on holding system 130 (see FIG. 12). Accordingly, with holding system 140 mounted to the sander, the forward portion of channels 142 and 144 are located ahead of the front end 68 of the sander body, similarly to the position of the forward portion of channel 130 shown in FIG. 8. Therefore, with sandpaper secured to the sanding surfaces of selected pads mounted in the forward portions of channels 142 and 144, at least a portion of selected particular cross sectional profiles can with power sanding be formed onto or sanded on a workpiece surface that might otherwise be inaccessible by the sander body.

Figure 8:
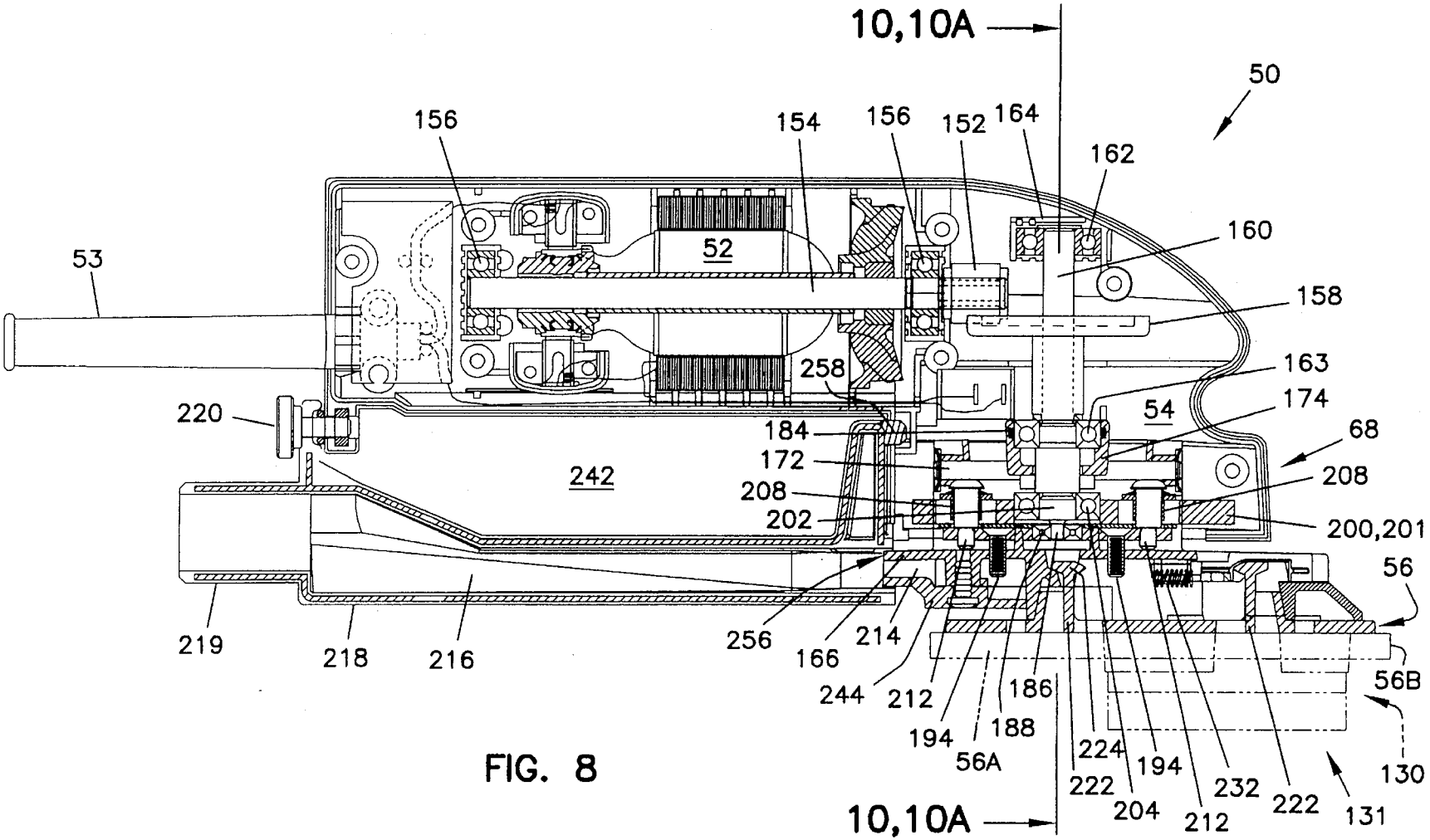
FIG. 8 is a right side elevational cross sectional profile (taken along cutting line 8—8 of FIG. 6) illustrating the preferred sander, as well as a preferred profiled pad holding system coupled to the sander.

While motor 52 is illustrated in FIG. 8 as an electric motor controlled by power switch 51 (see FIG. 1) and powered by line voltage coupled through power cord boot 53, the motor could be an electric motor powered by a rechargeable battery system, or it could be an air-powered motor. In the preferred embodiment, motor 52 typically has a nominal speed of approximately 18,000 revolutions per minute, and a three-to-one gear ratio may be used to turn the horizontal motor output vertically and to reduce the speed of rotation so that a nominal in-line stroke speed of approximately 6,000 strokes per minute (spm) is achieved. A stroke length of approximately 0.080 inch has been found acceptable in combination with the nominal stroke speed of approximately 6000 spm.

In developing the present system, the assignee of the present system experimented with a stroke length of approximately 0.060 inch with a stroke speed of approximately 18,000 spm, as well as with a stroke length of approximately 0.125 inch at stroke speed of approximately 9,000 spm. The small 0.060 inch stroke length at the relatively high speed of 18,000 spm resulted in relatively little material removal with some sanding pad configurations, and the larger stroke length of 0.125 at the speed of 9,000 spm typically caused aggressive removal of material but was found more difficult to control in some circumstances and to be relatively noisy. The selected stroke length of 0.080 inch at 6,000 spm was found to provide a combination of control, stock removal, and quietness. Other stoke lengths and speeds may also be acceptable, including variable stroke speed attained through the use of motor speed control.

Motor 52 powers the present in-line oscillating mechanism 54 through a set of face gears including a pinion face gear 152 (see FIG. 8) mounted on the end of motor shaft 154, which is secured into rotational position by bearings 156 having outer races secured within sander body 50. Pinion face gear 152 meshes with a horizontal face gear 158, which is shown schematically in, for example FIGS. 8, 11, 13, and 15.

Figure 13:
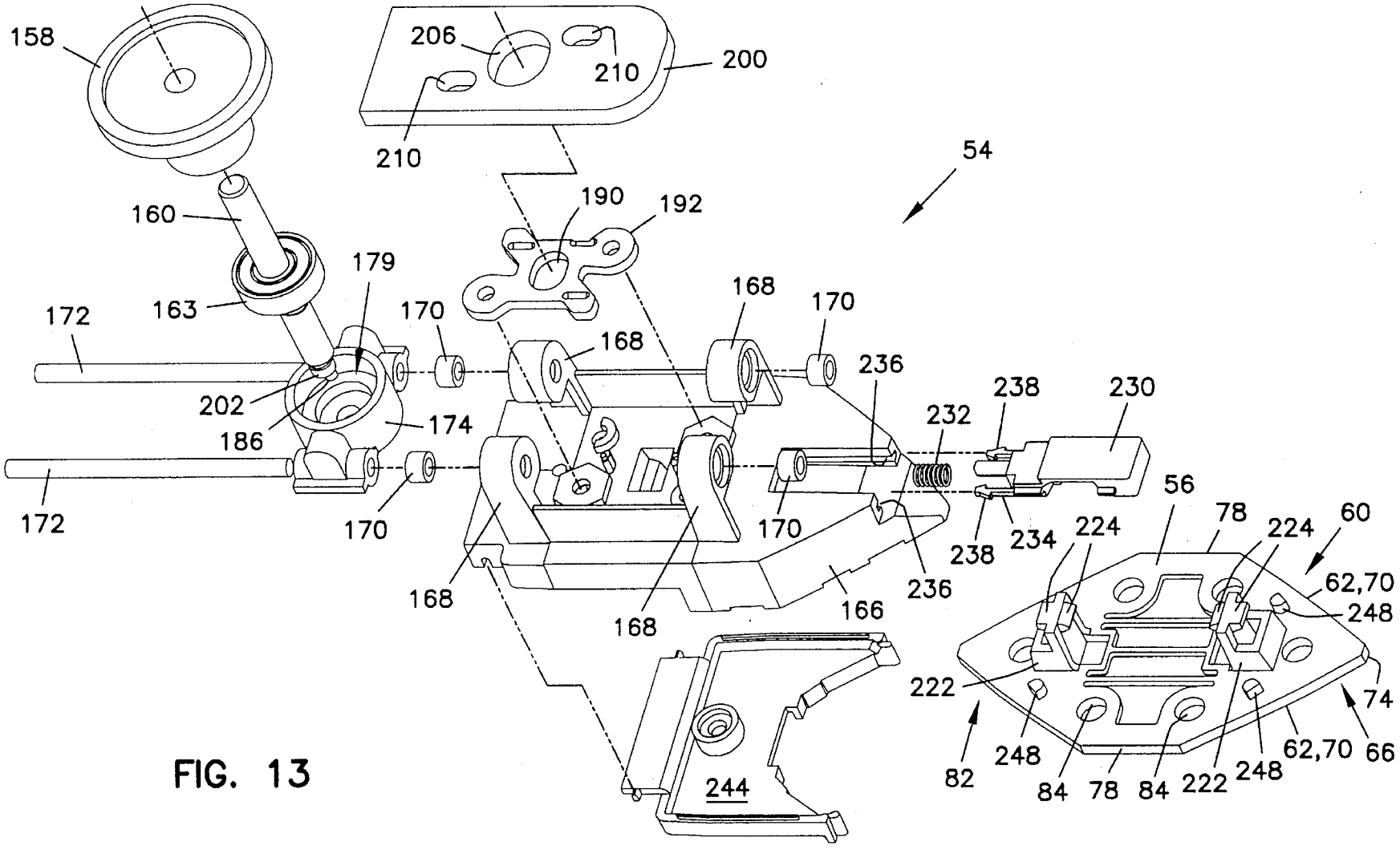
FIG. 13 is an exploded upper perspective view of portions of the preferred in-line oscillation system and an upper perspective view of a preferred corner or detail pad frame.

Face gear 158 is coupled to vertical drive shaft 160 held rotationally in place at the upper end of the shaft by an upper bearing 162 having an outer race coupled to a bearing housing 164 secured within sander body 50. Vertical drive shaft 160 is held rotationally in place at a lower portion of the shaft by a lower bearing 163, which has an outer race secured within a cavity 179 (see FIG. 13) of a bearing plate 174 by an o-ring 184 (see FIGS. 8 and 10). Bearing plate 174 is firmly attached to sander body 50 by two machine screws 180 (see FIG. 10), each of which thread into a tapped hole 182 (see FIGS. 11 and 15), one on each side of bearing plate 174 (note: FIG. 13 is schematic and does not show a tapped hole 182 on the visible side of bearing plate 174). The lower portion of vertical drive shaft 160 is coupled to a scotch yoke mechanism that causes vacuum housing 166 to move in a linear oscillating motion.

Vacuum housing 166 comprises four substantially vertical risers 168, each of which include at an upper portion a bronze bushing 170. The four bronze bushings 170 secured in the upper portion of vertical risers 168 provide sliding support to dowel pins 172, which pass through and are firmly attached to bearing plate 174. Accordingly, vacuum housing 166, supported by the four vertical risers 168 with bronze bushings sliding on dowel pins 172, is caused to move in a liner oscillating motion by a scotch yoke mechanism, which will now be described.

Figure 14:
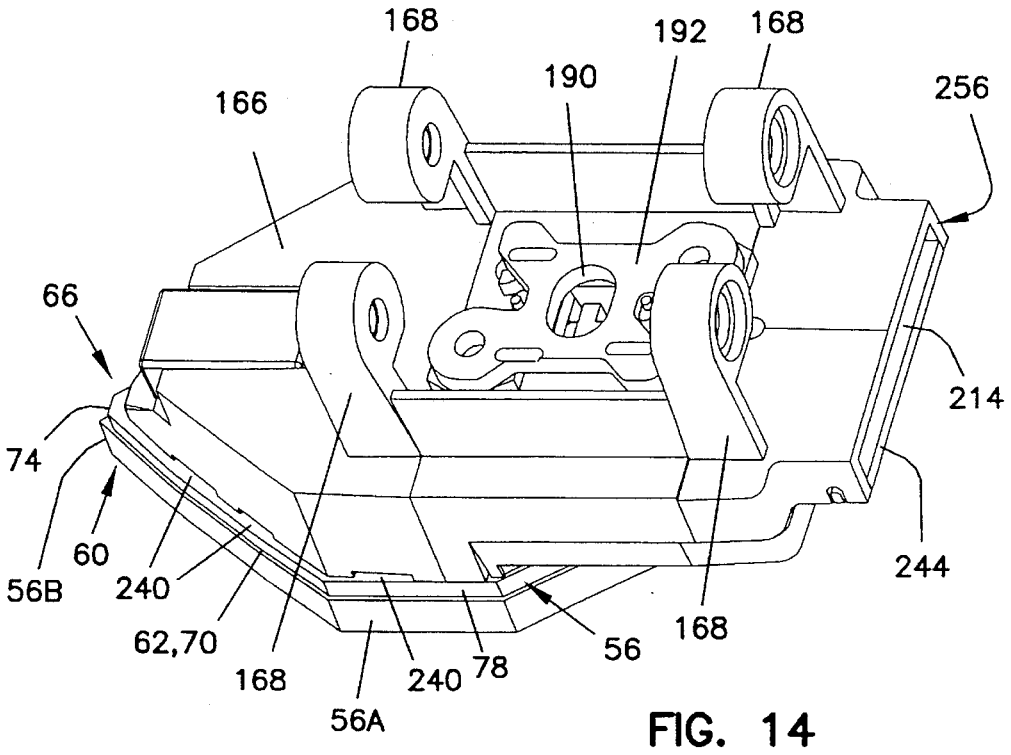
FIGS. 14 and 15 are perspective illustrations of partially assembled portions of the preferred in-line oscillation system.
Figure 16:
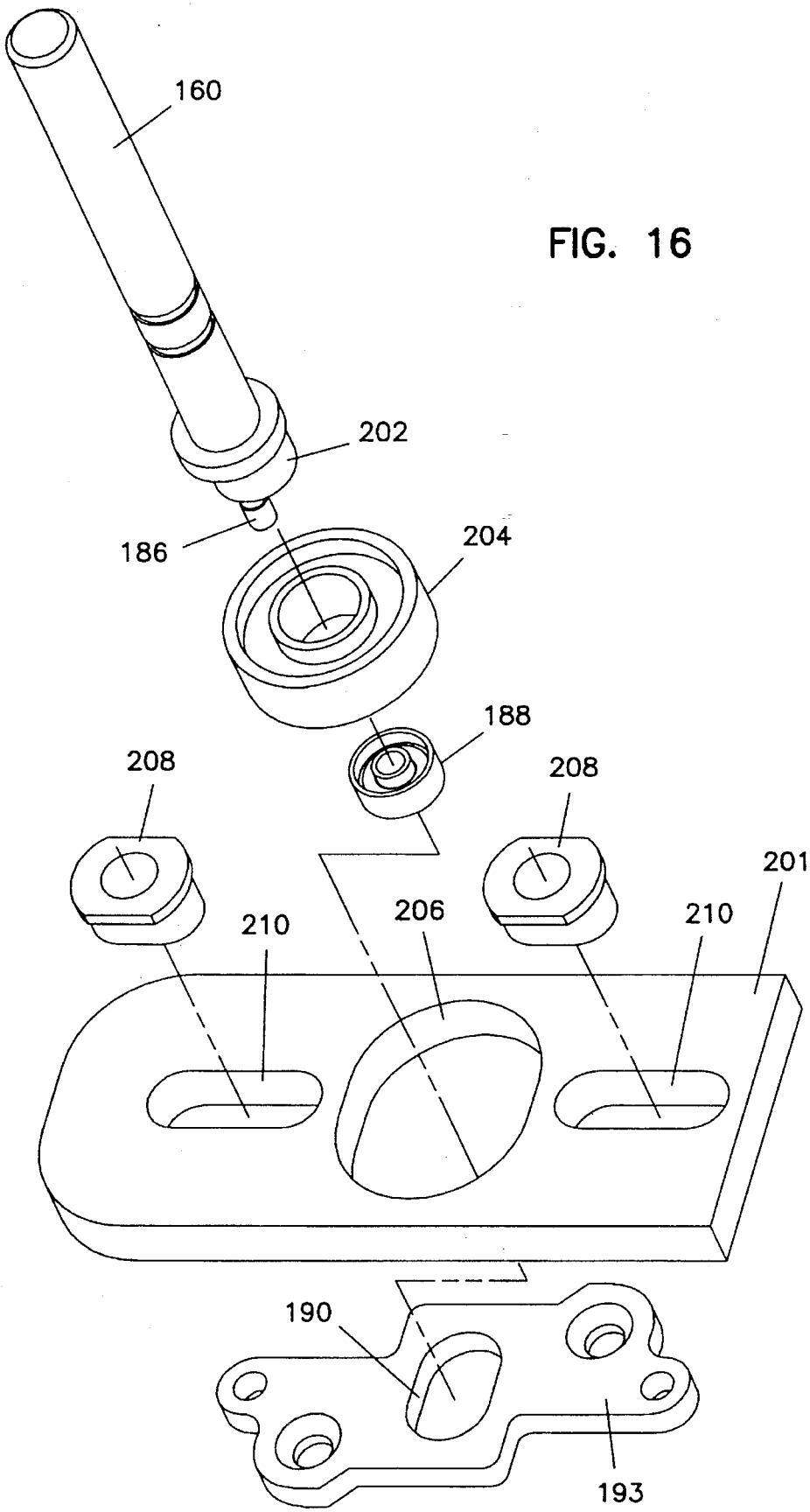
FIG. 16 is an exploded perspective view of components of the preferred in-line oscillation system.

A lower portion of drive shaft 160 comprises an eccentric shaft portion 186, which guides the inner race of vacuum-housing drive bearing 188. The outer race of vacuum-housing drive bearing 188 rides within an elongated opening 190 defined by a vacuum housing drive plate 192, 193 (note: a first embodiment of the vacuum housing drive plate, labeled 192, is shown in FIGS. 12, 13, and 14; a second embodiment of the vacuum housing drive plate, labeled 193, is shown in FIG. 16). The vacuum housing drive plate is secured to the vacuum housing by two machine screws 194 (see FIG. 8), the lower portion of machine screws 194 being secured by hex nuts 196 set within recesses 198 on the underside of vacuum housing 166 (see FIG. 12).

Elongated opening 190 defined by the vacuum housing drive plate has a width along the linear oscillating motion substantially equal to the outer diameter of vacuum-housing drive bearing 188, which rides within elongated opening 190. The length of elongated opening 190 across the linear oscillating motion is substantially greater than the outer diameter of vacuum housing drive bearing 188. This shape of elongated opening 190 causes the outer race of vacuum-housing drive bearing 188, which is eccentrically mounted on drive shaft portion 186, to move the vacuum housing in the in-line oscillating motion.

Figure 11:
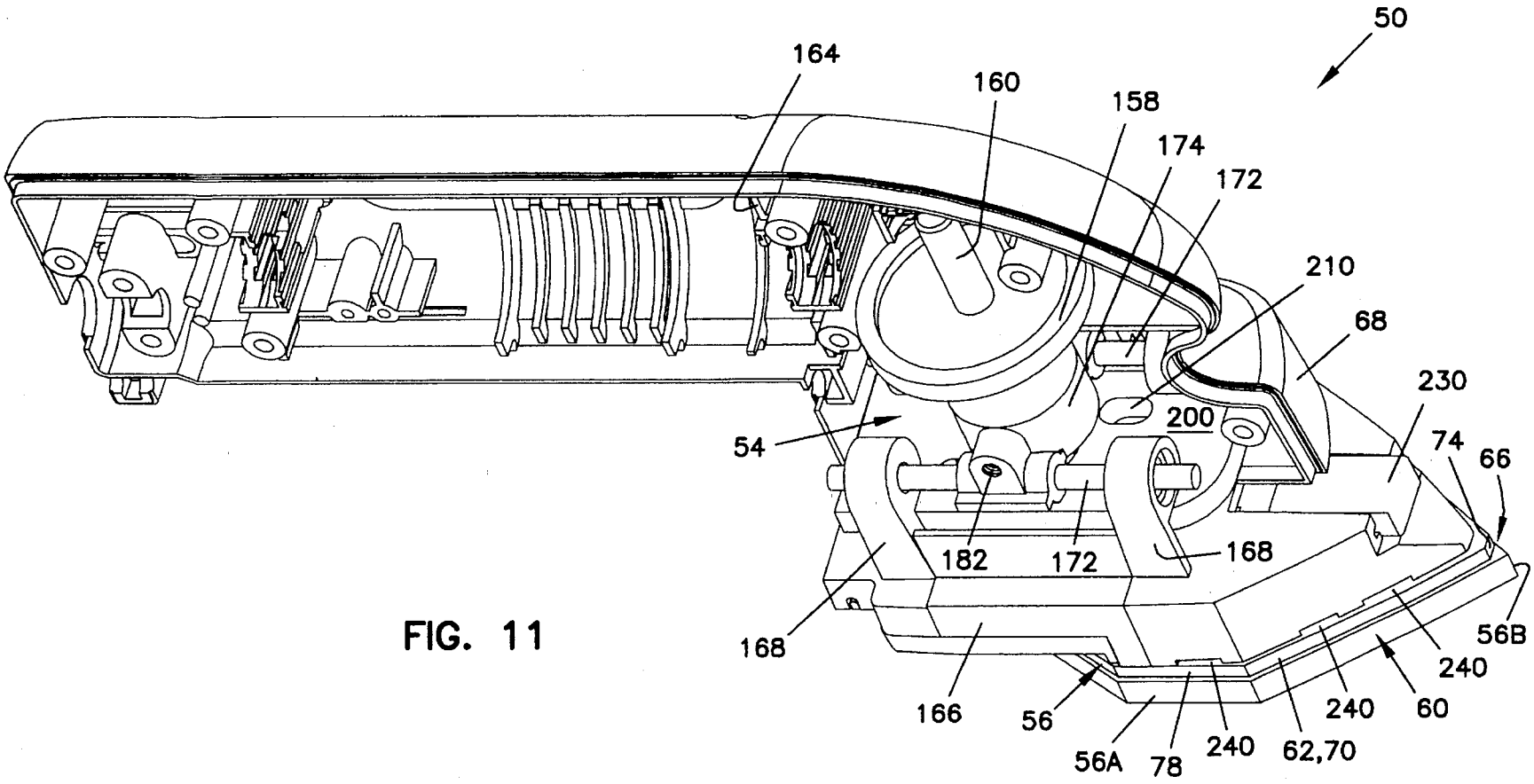
FIG. 11 is a partial cutaway drawing including an illustration of a portion of the preferred in-line oscillation system.
Figure 15:
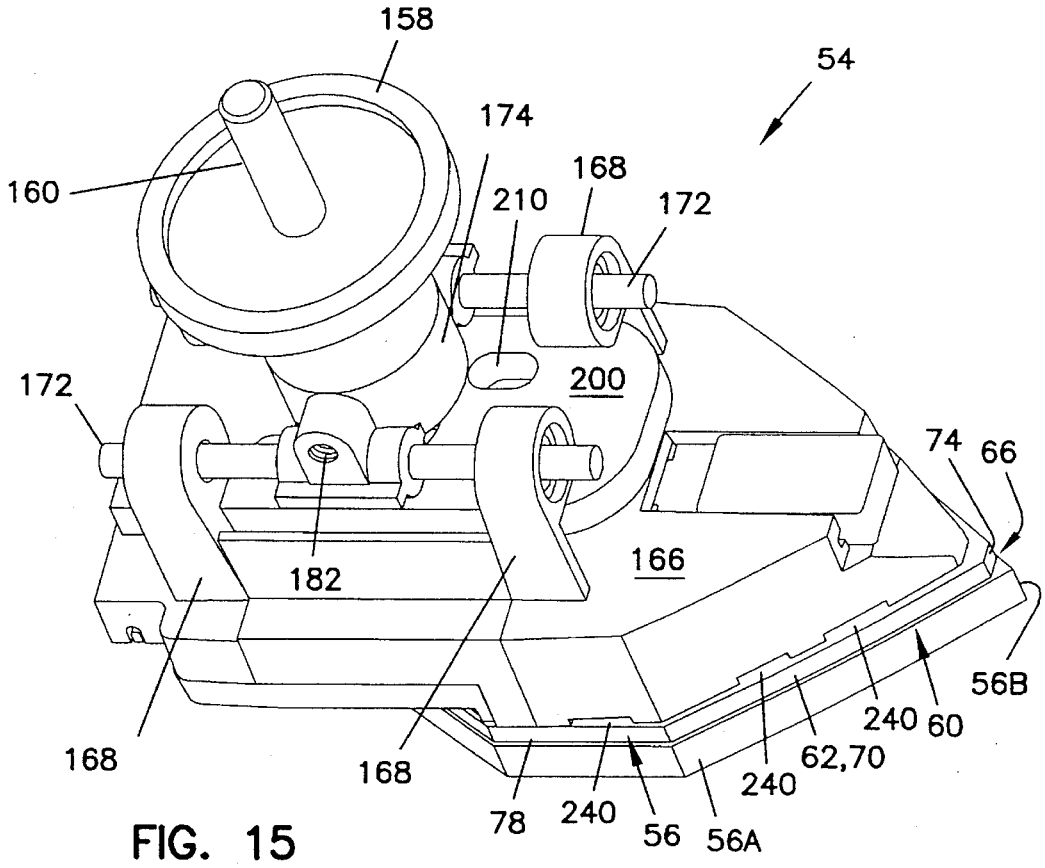

Sander body vibration which might otherwise be caused by the in-line oscillating motion of the vacuum housing and attached pad frame and pad is substantially offset by a counterweight 200, 201 (note: a first embodiment of the counterweight, labeled 200, is shown in FIGS. 11, 13, and 15; a second embodiment of the counterweight, labeled 201, is shown in FIG. 16). The counterweight is caused to move with an in-line oscillating motion 180 degrees out of phase with the in-line movement of the vacuum housing, as will now be described in more detail.

A lower portion of drive shaft 160 just above eccentric drive shaft portion 186, comprises a second eccentric portion 202 which is eccentrically out of phase by 180 degrees with eccentric portion 186. Eccentric portion 202 guides the inner race of a counterweight drive bearing 204. The outer race of counterweight drive bearing 204 rides within an elongated opening 206 (see FIGS. 13 and 16) defined by the counterweight.

Elongated opening 206 defined by the counterweight has a width along the linear oscillating motion substantially equal to the outer diameter of counterweight drive bearing 204, which rides within elongated opening 206. The length of elongated opening 206 across the linear oscillating motion is substantially greater than the outer diameter of counterweight drive bearing 204. This shape of elongated opening 206 causes the outer race of counterweight drive bearing 204, which is eccentrically mounted on drive shaft portion 202, to move the counterweight in an in-line oscillating motion, 180 degrees out of phase with the in-line oscillating motion of vacuum housing 166.

The counterweight is guided in an in-line oscillating motion by two bushings 208 (see FIG. 16), which ride within slots 210 elongated in line with the in-line oscillating motion (note: slots 210 are offset in counterweight embodiment 200, as shown in FIGS. 11, 13, and 15, and are aligned in counterweight embodiment 201, as shown in FIG. 16). Bushings 208 are held in place for guiding the counterweight by machine screws 212 (FIG. 8) secured to the vacuum housing drive plate.

With the weight of the counterweight and the combined weight of vacuum housing 166 and any pad frame and corresponding attached pad and abrasive being substantially equal, vibration of sander body 50 in a user's hand is substantially reduced or eliminated.

Vacuum housing 166 defines dust channel 214 (see FIGS. 8 and 14) for guiding dust collected through dust ports 88 and air flow dust ports 240 to a dust exhaust channel 216 within dust exhaust housing 218. A dust collection hose (not shown) may be connected on one end fitting 219 on the exit end of dust exhaust housing 218 and on the other end to a suitable separate vacuum cleaner or dust collector for collecting dust created by the sander.

A rear portion 256 (see FIGS. 8, 9, and 14) of the vacuum housing assembly (the assembly of vacuum housing 166 and vacuum housing cover 244) fits into the upstream or forward end of dust exhaust housing 218. A sliding interface between the exterior walls of portion 256 and the interior walls of dust exhaust housing 218 permits portion 256 of the vacuum housing assembly to move in an in-line oscillating motion within forward end of dust exhaust housing 218.

Dust exhaust housing 218 may be optionally removed by loosening thumb screw 220, which then permits housing 218 to be removed, such as to provide a lighter or more maneuverable sander (e.g., when no dust collection is desired, or in tight operating conditions). In the preferred embodiment, when thumb screw 220 is loosened, dust exhaust housing 218 is easily removed by pulling housing 218 down and away from the front of the sander (when installed, the forward portion of housing 218 is held in place by a pin 258 which fits into an corresponding hole in the sander body).

The present invention is to be limited only in accordance with the scope of the appended claims, since persons skilled in the art may devise other embodiments still within the limits of the claims. For example, many of the preferred features of the present sander or sander systems described in the present application are not limited to an in-line sander.

What is claimed is:

1. An in-line sander, comprising:

(a) a sander body which houses a motor coupled to an in-line oscillating mechanism, the in-line oscillating mechanism being adapted and configured to move a sanding pad in a linear oscillating motion; and (b) a profiled sanding pad coupled to the in-line oscillating mechanism, the profiled sanding pad having, in a plane substantially perpendicular to the linear oscillating motion, a particular non-linear cross sectional profile which defines, substantially consistently along the length of the pad, a non-linear sanding surface corresponding to a profile to be formed onto or to be sanded on a workpiece, whereby sandpaper secured to the sanding surface of the profiled sanding pad will power sand the profile to be formed onto or to be sanded on a workpiece.

2. The in-line sander of claim 1, wherein the profiled sanding pad is coupled to the in-line oscillating mechanism so that at least a portion of the pad protrudes ahead of the front end of the sander body throughout the linear oscillating motion, whereby, when sandpaper is secured to the portion of the pad which protrudes ahead of the front end of the sander body throughout the linear oscillating motion, the protruding portion can be used to power sand the profile to be formed onto or to be sanded on a workpiece on a surface which is otherwise blocked from access by the sander body.

3. The in-line sander of claim 1, wherein:

(a) the in-line oscillating mechanism is adapted and configured to selectively receive and move in a linear oscillating motion at least one of a plurality of distinctly profiled sanding pads; and (b) the sander comprises a system of distinctly profiled sanding pads, each distinctly profiled sanding pad within the system being adapted and configured to be selectively coupled to the in-line oscillating mechanism, each distinctly profiled sanding pad having, in a plane substantially perpendicular to the linear oscillating motion, a distinct particular non-linear cross sectional profile which defines, substantially consistently along the length of the pad, a non-linear sanding surface corresponding to a profile to be formed onto or to be sanded on a workpiece, whereby sandpaper secured to the sanding surface of any pad in the system will, when the corresponding pad is coupled to the in-line oscillating mechanism, power sand onto the workpiece the profile having the distinct particular cross section of the selected pad.

4. The in-line sander of claim 1, wherein the in-line oscillating mechanism is adapted and configured to move in a linear oscillating motion a plurality of profiled sanding pads selected from a system of profiled sanding pads, the selected pads being coupled at spaced-apart locations onto the in-line oscillating mechanism, whereby sandpaper secured to the sanding surfaces of the profiled pads will, when the selected pads are coupled to the in-line oscillating mechanism, selectively and alternately power sand onto the workpiece the profiles having the distinct particular cross sections of the selected plurality of pads secured to the in-line oscillating mechanism.

5. The in-line sander of claim 4, wherein the plurality of profiled sanding pads are coupled to the in-line oscillating mechanism so that at least a portion of the pads protrude ahead of the front end of the sander body throughout the linear oscillating motion, whereby, when sandpaper is secured to the protruding portions of the pads throughout the linear oscillating motion, the protruding portions can be used to power sand the one or more profiles corresponding to the plurality of profiled pads on a surface which is otherwise blocked from access by the sander body.

6. The in-line sander of claim 1 wherein the sander body comprises a substantially barrel-shaped portion, the barrel-shaped portion of the sander body having a diameter substantially equal to or less than the maximum width of the sander body, wherein the barrel-shaped portion of the sander body is adapted and configured to be grasped by a user's hand.

7. The in-line sander of claim 1 wherein the sander defines dust ports which are proximate the profiled sanding pad and are coupled to a dust collection system for collecting dust generated by the sander.

8. A profiled sanding system, comprising:

(a) a pad-holding portion adapted and configured for holding in position for movement in a linear oscillating motion a profiled sanding pad having, in a plane substantially perpendicular to the linear oscillating motion, a particular cross sectional profile which defines, substantially consistently along the length of the pad, a non-linear sanding surface corresponding to a profile to be formed onto or to be sanded on a workpiece; and (b) a pad frame coupled to the pad holding portion and adapted and configured for moving the profiled sanding pad in the linear oscillating position, whereby a profiled sanding pad, when held by the holding portion and when comprising sandpaper secured to the sanding surface of the pad can be moved by the pad frame in order to sand the profile to be formed onto or to be sanded on a workpiece.

9. The profiled sanding system of claim 8 wherein the pad frame is adapted and configured to be secured to an in-line motor-powered sander wherein the sander comprises an in-line oscillating mechanism adapted and configured to move a sanding pad in a linear oscillating motion under motor power, whereby, when the pad frame is mounted to the in-line sander, the user can power sand the profile to be formed onto or to be sanded on a workpiece.

10. The profiled sanding system of claim 9 wherein the holding portion is adapted and configured to hold a profiled sanding pad having an upper portion defining a particular holding cross sectional configuration extending substantially consistently along the length of the pad, wherein the holding portion defines at least one substantially downward-facing channel having first and second sides configured to secure the holding cross sectional configuration of the profiled pad.

11. The profiled sanding system of claim 9 wherein the at least one substantially downward-facing channel is adapted and configured so that any selected profiled sanding pad, when coupled to the at least one channel, may be positioned so that at least a portion of the pad protrudes ahead of the front end of the sander body throughout the linear oscillating motion, whereby, when sandpaper is secured to the protruding portion of the pad throughout the linear oscillating motion, the protruding portion can be used to power sand the profile to be formed onto or to be sanded on a workpiece on a surface which is otherwise blocked from access by the sander body.

12. The profiled sanding system of claim 10 wherein the holding portion further defines substantially-vertically-oriented ridges on the sides of the at least one substantially downward-facing channel to assist in securing the holding cross sectional configuration of the profiled pad.

13. The profiled sanding system of claim 10 wherein the holding portion defines two substantially downward-facing, channels, each channel defining an axis of symmetry substantially parallel to the linear oscillating motion, each channel having first and second sidewalls configured to secure the holding cross sectional configuration of a profiled pad.

14. The profiled sanding system of claim 13 wherein the holding portion further defines substantially-vertically-oriented ridges on the inner surfaces of the sidewalls of the substantially downward-facing channels to assist in securing the holding cross sectional configurations of the profiled pads in the channels.

15. The profiled sanding system of claim 13 wherein:

(a) the sander body has a maximum width along the length of the sander body; and (b) the two substantially downward-facing channels are each angled at least slightly outward from one another and are located so that any profiled sanding pad secured within either of the two channels has at least a portion of the pad sanding surface projecting laterally past the sander body maximum width, whereby, with sandpaper secured to the sanding surfaces of selected pads mounted in the channels, at least a portion of selected particular cross sectional profiles can be power-sanded onto a surface a profile that might otherwise be blocked by the sander body.

16. The profiled sanding system of claim 15, wherein the two substantially downward-facing channels are each located such that any profiled sanding pad secured within either of the two channels may be positioned so that at least a portion of the pad sanding surface protrudes ahead of the front end of the sander body throughout the linear oscillating motion, whereby, with sandpaper secured to the sanding surfaces of selected pads mounted in the channels, at least a portion of selected particular cross sectional profiles can be power-sanded onto a surface a profile that might otherwise be blocked by the sander body.

* * * * *